US007866650B2

(12) United States Patent
Nomura et al.

(10) Patent No.: US 7,866,650 B2
(45) Date of Patent: Jan. 11, 2011

(54) SHEET PROCESSING APPARATUS AND IMAGE FORMING APPARATUS INCLUDING THE SAME

(75) Inventors: Tomoichi Nomura, Aichi (JP); Masahiro Tamura, Kanagawa (JP); Nobuyoshi Suzuki, Tokyo (JP); Shuuya Nagasako, Kanagawa (JP); Kazuhiro Kobayashi, Kanagawa (JP); Makoto Hidaka, Tokyo (JP); Hitoshi Hattori, Tokyo (JP); Shohichi Satoh, Kanagawa (JP); Akira Kunieda, Tokyo (JP); Hiroshi Maeda, Aichi (JP); Ichiro Ichihashi, Aichi (JP)

(73) Assignee: Ricoh Company, Ltd., Tokyo (JP)

( * ) Notice: Subject to any disclaimer, the term of this patent is extended or adjusted under 35 U.S.C. 154(b) by 334 days.

(21) Appl. No.: 11/976,132

(22) Filed: Oct. 22, 2007

(65) Prior Publication Data

US 2008/0099974 A1 May 1, 2008

(30) Foreign Application Priority Data

Oct. 27, 2006 (JP) ..... 2006-292894

(51) Int. Cl.
*B65H 37/04* (2006.01)

(52) U.S. Cl. ..... 270/58.12; 270/58.07; 270/58.08; 270/58.11; 270/58.17; 270/58.27

(58) Field of Classification Search ..... 270/58.07, 270/58.08, 58.11, 58.12, 58.17, 58.27
See application file for complete search history.

(56) References Cited

U.S. PATENT DOCUMENTS

| | | | | |
|---|---|---|---|---|
| 5,472,181 | A * | 12/1995 | Lowell | 270/58.09 |
| 6,145,825 | A * | 11/2000 | Kunihiro et al. | 270/58.09 |
| 7,052,005 | B2 * | 5/2006 | Yamakawa et al. | 270/37 |
| 2006/0120784 | A1 * | 6/2006 | Iida et al. | 399/407 |
| 2006/0261544 | A1 | 11/2006 | Tamura et al. | |
| 2006/0290044 | A1 * | 12/2006 | Taguchi et al. | 270/58.08 |
| 2007/0051219 | A1 | 3/2007 | Tamura et al. | |
| 2007/0096380 | A1 * | 5/2007 | Okumura | 270/58.08 |
| 2007/0138726 | A1 | 6/2007 | Tamura et al. | |

FOREIGN PATENT DOCUMENTS

| | | | |
|---|---|---|---|
| JP | 2000211795 | A * | 8/2000 |
| JP | 2005-060106 | | 3/2005 |
| JP | 3655407 | | 3/2005 |
| JP | 2006-036480 | | 2/2006 |
| JP | 3943965 | | 4/2007 |

* cited by examiner

*Primary Examiner*—Leslie A Nicholson, III
(74) *Attorney, Agent, or Firm*—Harness, Dickey & Pierce, P.L.C.

(57) ABSTRACT

An aligning unit aligns a front end of a sheet bundle stacked in a tray in a discharging direction. A sheet bundle conveying unit holds a rear end of the sheet bundle and conveys the sheet bundle in the discharging direction. The aligning unit is arranged to be retracted from a conveying path of the sheet bundle after aligning the front end of the sheet bundle and to come out in the conveying path of the sheet bundle behind the sheet bundle conveying unit after a movement of the sheet bundle conveying unit.

10 Claims, 34 Drawing Sheets

SHEET PROCESSING APPARATUS AND IMAGE FORMING APPARATUS INCLUDING THE SAME

CROSS-REFERENCE TO RELATED APPLICATIONS

The present application claims priority to and incorporates by reference the entire contents of Japanese priority document, 2006-292894 filed in Japan on Oct. 27, 2006.

BACKGROUND OF THE INVENTION

1. Field of the Invention

The present invention relates to a technology for sorting, binding, and stacking printed sheets discharged from an image forming apparatus.

2. Description of the Related Art

In a sheet processing apparatus that receives printed sheets fed from a discharging unit in an image forming apparatus provided outside or inside the sheet processing apparatus to stack these sheets on a staple tray and staples them into a bundle including a predetermined number of sheets by using a stapling unit to discharge this bundle to a paper discharge tray, a rear end of the sheet bundle is aligned by using a rear end fence on the staple tray to staple the bundle with an excellent accuracy or to convey the sheet bundle.

A sheet processing apparatus that pushes a front end of a sheet bundle toward a rear end fence side by using a rear surface of a discharge claw as a sheet bundle conveying unit that discharges the sheet bundle from a staple tray in a paper discharging direction, brings a rear end of the sheet bundle into contact with the rear end fence to align both the rear end and the front end, and conveys the aligned sheet bundle is proposed to improve alignment properties of the sheet bundle when aligning the rear end of the sheet bundle by using the rear end fence (see, for example, Japanese Patent Application Laid-open No. 2005-60106).

However, in the sheet processing apparatus according to Japanese Patent Application Laid-open No. 2005-60106, because the front end of the sheet bundle is pushed toward the rear end fence side by using the rear surface of the discharge claw when aligning the front end of the sheet bundle, the sheet bundle must be carried from the rear end fence by using the discharge claw and then moved to a position where the next sheet is received to enter a standby mode, and thereafter the sheet must be put into the staple tray. Therefore, this sheet processing apparatus has a problem that a waiting time until the sheet is put into the staple tray becomes long, thereby reducing productivity for producing the sheet bundles.

SUMMARY OF THE INVENTION

It is an object of the present invention to at least partially solve the problems in the conventional technology.

A sheet processing apparatus according to one aspect of the present invention includes a conveying unit that conveys a sheet, a tray where a carried sheet is stacked, an aligning unit that aligns a front end of a sheet bundle stacked in the tray in a discharging direction, and a sheet bundle conveying unit that holds a rear end of the sheet bundle and conveys the sheet bundle in the discharging direction. The aligning unit is arranged to be retracted from a conveying path of the sheet bundle after aligning the front end of the sheet bundle and to come out in the conveying path of the sheet bundle behind the sheet bundle conveying unit after a movement of the sheet bundle conveying unit.

An image forming apparatus according to another aspect of the present invention includes a sheet processing apparatus that includes a conveying unit that conveys a sheet, a tray where a carried sheet is stacked, an aligning unit that aligns a front end of a sheet bundle stacked in the tray in a discharging direction, and a sheet bundle conveying unit that holds a rear end of the sheet bundle and conveys the sheet bundle in the discharging direction. The aligning unit is arranged to be retracted from a conveying path of the sheet bundle after aligning the front end of the sheet bundle and to come out in the conveying path of the sheet bundle behind the sheet bundle conveying unit after a movement of the sheet bundle conveying unit.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 8A is a view of a state where front ends of sheets are aligned by the front end tapper, FIG. 8B is a view of a state where the front end tapper is retracted, FIG. 8C is a view of a state where a sheet bundle is carried by the discharge claw, FIG. 8D is a view of a state where the front end tapper flows up the discharge claw, FIG. 8E is a view of a state where the front end tapper is placed at a home position, and FIG. 8F is a view of a state where the front end tapper moves down a sheet front end;

FIG. 10A is a view of a state where front ends of sheets are aligned, and FIG. 10B is a view of a state where the sheets are biased;

FIG. 12A is a view of a home position of the rear end presser lever, and FIG. 12B is a view of an arrangement relationship of the rear end presser lever when staple processing is performed at a rear end of a sheet bundle or a front side of a machine;

FIG. 13A is a view of an arrangement relationship of the rear end presser lever when staple processing is performed at the rear end of the sheet bundle at the center of the machine, and FIG. 13B is a view of an arrangement relationship of the rear end presser lever when staple processing is effected at the rear end of the sheet bundle on an inner side of the machine;

FIG. 17A is a view of the mechanism when the sheet bundle is not carried, and FIG. 17B is a view of a state immediately before the sheet bundle is carried to a runner and a driven roller;

FIG. 18A is a view of the changing mechanism when the sheet bundle is carried to a processing tray G, and FIG. 18B is a view of the changing mechanism when the sheet bundle is carried to the shift tray;

FIG. 21A is a view of a state where the sheet bundle is carried to a processing tray G, and FIG. 21B is a view of a state where the sheet bundle is carried to a shift tray;

FIG. 25A is a view of a state where the folding plate is protruded, and FIG. 25B is a view of a state where the folding plate is retracted;

FIG. 26A is a view of an outline structure of the entire changing mechanism, FIG. 26B is a view of a state where the sheet bundle is aligned on the rear end fence, FIG. 26C is a view of a state where the sheet bundle is carried by using the discharge claw, FIG. 26D is a view of a state where the sheet bundle is carried to the processing tray G, and FIG. 26E is a view of a state where the sheet bundle is stacked on a movable rear end fence;

FIG. 27A is a view of the saddle stitch processing for sheets, FIG. 27B is a view of a state where a central part of the sheet bundle is carried to a centerfold plate, FIG. 27C is a view of a state where the sheet bundle is centerfolded, and FIG. 27D is a view of a state where the centerfolded sheet bundle is carried.

DETAILED DESCRIPTION OF THE PREFERRED EMBODIMENTS

Exemplary embodiments of the present invention are explained in detail below with reference to the accompanying drawings.

Figure 1:
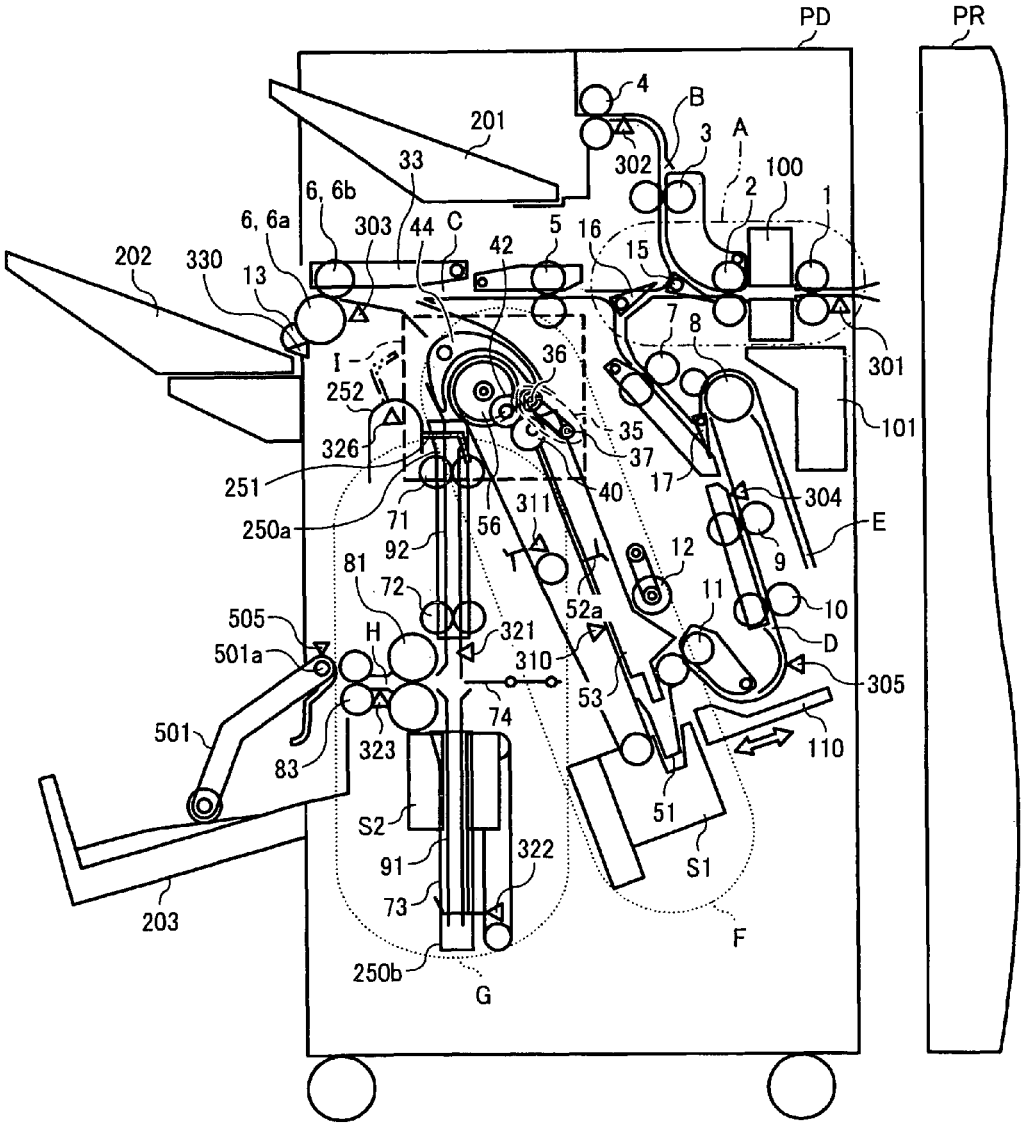
FIG. 1 is a view of an outline structure of an image forming apparatus according to an example of the present invention.

FIG. 1 is a view of a system configuration of an image forming apparatus including a sheet post-processing unit device as a sheet processing apparatus and an image forming unit device according to an example of the present invention, and this drawing depicts the entire sheet post-processing unit device and a part of the image forming unit device.

As shown in FIG. 1, a sheet post-processing unit device PD is disposed on a lateral side of an image forming unit device PR, and a sheet (recording medium) P having an image formed thereon discharged from the image forming unit device PR is led to the sheet post-processing device PD. The sheet is configured to pass through a conveying path A having a post-processing unit (punch unit 100 as a punching unit in this embodiment) that performs post-processing with respect to one sheet and to be distributed by a branch claw 15 and a branch claw 16 to a conveying path B leading to an upper tray 201 via conveying roller pairs (hereinafter, simply "conveying rollers") 2, 3, and 4, a conveying path C leading to a shift tray 202 via conveying rollers 2, 5, and 6, and a conveying path D leading to a processing tray F (also hereinafter, "staple processing tray") that performs, e.g., alignment or staple binding via conveying rollers 7, 8, 9, and 10 and a staple paper discharge roller 11. A tray surface of this staple processing tray F where sheets are staked is inclined in such a manner that a downstream side in a conveying direction of the sheet P discharged from the staple paper discharge roller 11 faces up, and this inclination angle is set to a minimum angle that does not interfere with a centerfold plate 74, a driving mechanism thereof, or a mechanism, e.g., a facet binding stapler S1 on a lower side of an inclined surface with respect to a direction of a gravitational force.

A sheet bundle PB led to the staple processing tray F via the conveying paths A and D and subjected to alignment, stapling, and others in the staple processing tray F is distributed to the conveying path C leading to the shift tray 202 or a processing tray G (also hereinafter, "centerfold or saddle stitch processing tray") via a branch conveying path I including a branch guide plate 54 and a guide member 44 that will be explained later. The sheet subjected to, e.g., folding in the centerfold processing tray G is led to a lower tray 203 via a conveying path H. A branch claw 17 is arranged in the conveying path D, and the state depicted in the drawing is held by a non-depicted spring. After a rear end of the sheet P passes the branch claw 17, at least the conveying rollers 9 of the conveying rollers 9 and 10 and the staple paper discharge rollers 11 are rotated in a reverse direction, the sheet rear end is led to a pre-stack path (sheet accommodating unit) E where the sheet stays, the next sheet is laminated on this sheet, and these sheets can be carried in this state. When this operation is repeated, the two or more sheets can be carried in a laminated state.

In the conveying path A that is common to the conveying path B, the conveying path C, and the conveying path D on an upstream side are sequentially arranged an inlet sensor 301 that detects the sheet P received from the image forming unit device PR, inlet rollers 1 provided on a downstream side, a punch unit 100, a punch chip hopper 101, conveying rollers 2, the branch claw 15, and the branch claw 16. The branch claw 15 and the branch claw 16 are held in the state depicted in FIG. 1 by a non-depicted spring. When a non-depicted solenoid is turned on, the branch claw 15 swivels upwards, and the branch claw 16 swivels downwards, thereby distributing the sheet to the conveying path B, the conveying path C, and the conveying path D.

When leading the sheet to the conveying path B, the branch claw 15 turns off the solenoid in the state depicted in FIG. 1. When leading the sheet to the conveying path C, the solenoid is turned on from the state depicted in FIG. 1. As a result, the branch claw 15 swivels upwards, and the branch claw 16 swivels downwards, respectively. When leading the sheet to the conveying path D, the branch claw 16 turns off the solenoid in the state depicted in FIG. 1, and the branch claw 15 turns on the solenoid from the state depicted in FIG. 1. As a result, they are swiveled upwards.

This sheet post-processing apparatus can perform each processing, e.g., punching (punch unit 100), sheet sorting (shift tray 202), sheet alignment and sheet end binding (front end tapper 512, facet binding stapler S1), and sheet alignment, saddle stitching, and centerfolding (front end tapper 512, saddle stitch stapler S2, folding plate 74, bending rollers 81) with respect to the sheet P.

In this embodiment, the image forming unit device PR is an image forming unit device using a so-called electrophotographic process of performing optical writing on an image forming medium, e.g., a photosensitive drum based on input image data to form a latent image on a surface of the photosensitive drum, toner-developing the formed latent image, transferring the developed image onto a recording medium, e.g., a sheet, and fixing the transferred image, and discharging the paper sheet. Because the image forming apparatus using the electrophotographic process itself is well known, an explanation and a drawing of a detailed structure will be omitted here. It is to be noted that the image forming unit device using the electrophotographic process is exemplified in this example. However, it is needless to say that a known image forming apparatus, e.g., an inkjet or a printer and a system using a printer can be likewise adopted.

(1) Sheet sorting, (2) sheet alignment and sheet end binding, and (3) sheet alignment, saddle stitching, and centerfolding by the sheet post-processing apparatus according to this embodiment will now be explained together with a specific structure thereof.

(1) Sheet Sorting Processing

Processing of sorting the sheet P or the sheet bundle PB is processing of sorting the sheet P carried via the conveying path A and the conveying path C or the sheet bundle PB formed in the processing tray F according to a predetermined number of sheets (or a predetermined number of copies). Shift paper discharge rollers 6, a return runner 13, a paper surface detection sensor 330, the shift tray 202, an elevating mechanism of the shift tray 202 depicted in FIG. 3, an oscillating mechanism of the shift tray 202 depicted in FIG. 2 constitute this processing.

Figure 3:
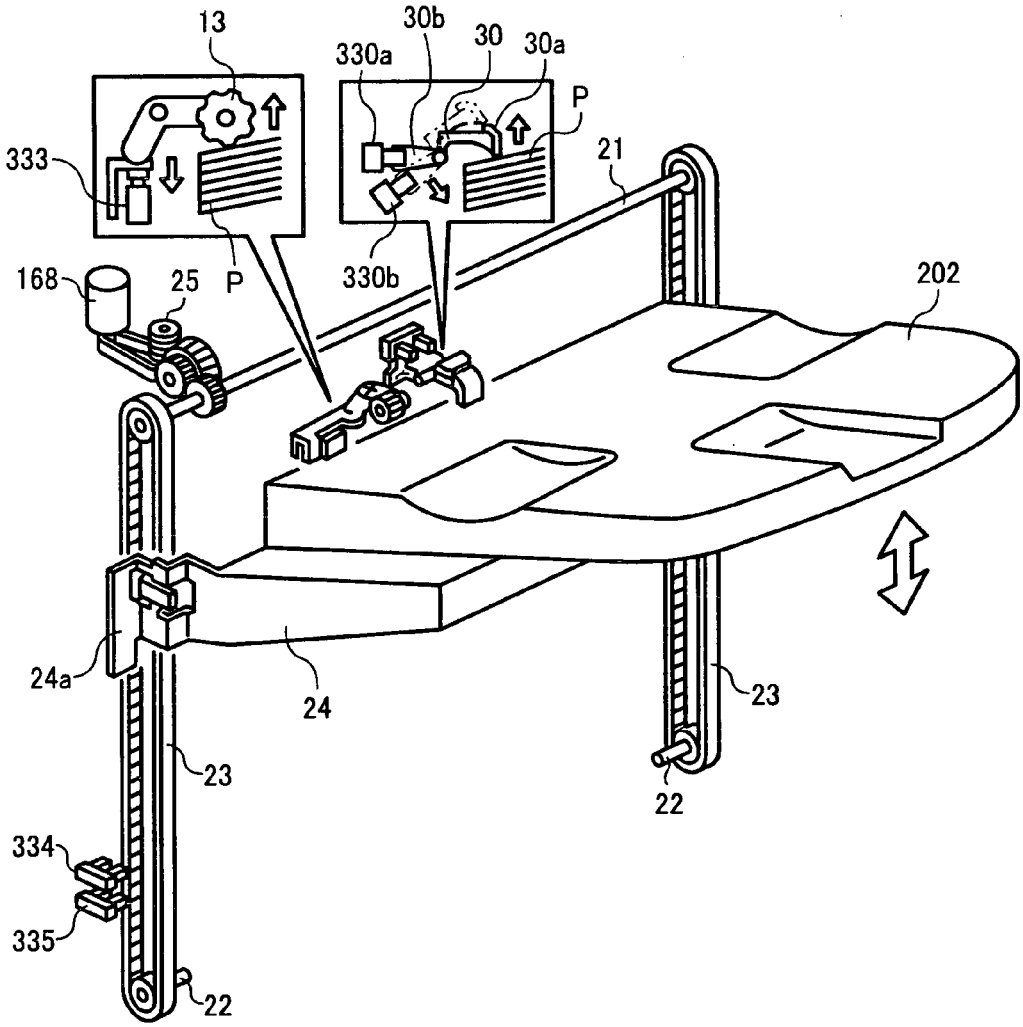
FIG. 3 is a perspective view of an elevating mechanism of the shift tray used in the sheet post-processing unit device in the image forming apparatus according to the embodiment of the present invention.

As shown in FIG. 3, reference numeral 13 denotes a return runner made of a sponge that comes into contact with the sheet P discharged from the shift paper discharge rollers 6 to bring a rear end of the sheet P into contact with a non-depicted end fence 32 where the rear end is aligned. The return runner 13 rotates in a direction indicated by an arrow A based on a rotating force of the shift paper discharge rollers 6 to convey the sheet P in a direction opposite to a discharging direction of the sheet P. A tray upward movement limit switch 333 is provided near the return runner 13. When the shift tray 202 moves up to push up the return runner 13, the tray upward movement limit switch 333 is turned on, and a tray elevating motor 168 is stopped. As a result, overrun of the shift tray 202 is avoided.

As shown in FIG. 1, the paper surface detection sensor 330 as a paper surface position detecting unit that detects a paper surface position of the shift tray 202 is provided near the return runner 13. Although not depicted in FIG. 1, the paper surface detection sensor 330 includes a paper surface detection lever 30 depicted in FIG. 3, a paper surface detection sensor (for staple) 330*a*, and a paper surface detection sensor (for non-staple) 330*b*. The paper surface detection lever 30 is provided in such a manner that it can swivel around a shaft 30*c* thereof, and has a contact unit 30*a* that comes into contact with a rear end upper surface of the sheet P stacked in the shift tray 202 and a fan-shaped shield unit 30*b*. The paper surface detection sensor (for staple) 330*a* placed on an upper side is mainly used for staple paper discharge control, and the paper surface detection sensor (for non-staple) 330*b* is mainly used for shift paper discharge control. According to this example, when shielded by the shield unit 30*b*, the paper surface detection sensor (for staple) 330*a* or the paper surface detection sensor (for non-staple) 330*b* is turned on. Therefore, when the shift tray 202 moves up and the contact unit 30*a* of the paper surface detection lever 30 swivels upwards, the paper surface detection sensor (for staple) 330*a* is turned off. When the contact unit 30*a* further swivels, the paper surface detection sensor (for non-staple) 330*b* is turned on. When the paper surface detection sensor (for staple) 330*a* and the paper surface detection sensor (for non-staple) 330*b* detect that a sheet stacking amount reaches a predetermined height, the shift tray 202 is moved down by a predetermined distance. As a result, the paper surface position of the shift tray 202 is maintained substantially constant.

<Elevation of Shift Tray>

The elevating mechanism of the shift tray 202 will now be explained in detail. As shown in FIG. 3, the shift tray 202 elevates when a driving shaft 21 is driven by a driving unit including the tray elevating motor 168, a warm gear 25, and others. A timing belt 23 is wound around the driving shaft 21 and a driven shaft 22 via a timing pulley with a tension. A side plate 24 that supports the shift tray 202 is fixed to this timing belt 23, and a unit including the shift tray 202 is suspended by this structure so as to enable elevation. A motive energy generated by the tray elevating motor 168 that can rotate in both forward and backward directions as a driving source that moves the shift tray 202 in a vertical direction is transmitted to a last gear in a gear train fixed to the driving shaft 21 via the warm gear 25. Because the energy is transmitted through the warm gear 25, the shift tray 202 can be maintained at a fixed position, thereby avoiding, e.g., a sudden falling accident of the shift tray 202.

A shield plate 24*a* is integrally formed on the side plate 24 of the shift tray 202, a full-load detection sensor 334 that detects a fully loaded state of the stacked sheets and a lower limit sensor 335 that detects a lower limit position are arranged on a lower side, and the shield plate 24*a* turns on/off the full-load detection sensor 334 and the lower limit sensor 335. Each of the full-load detection sensor 334 and the lower limit sensor 335 is a photo sensor, and it is turned on when shielded by the shield plate 24*a*. It is to be noted that the shift paper discharge rollers 6 are omitted in FIG. 3.

<Oscillation of Shift Tray>

Figure 2:
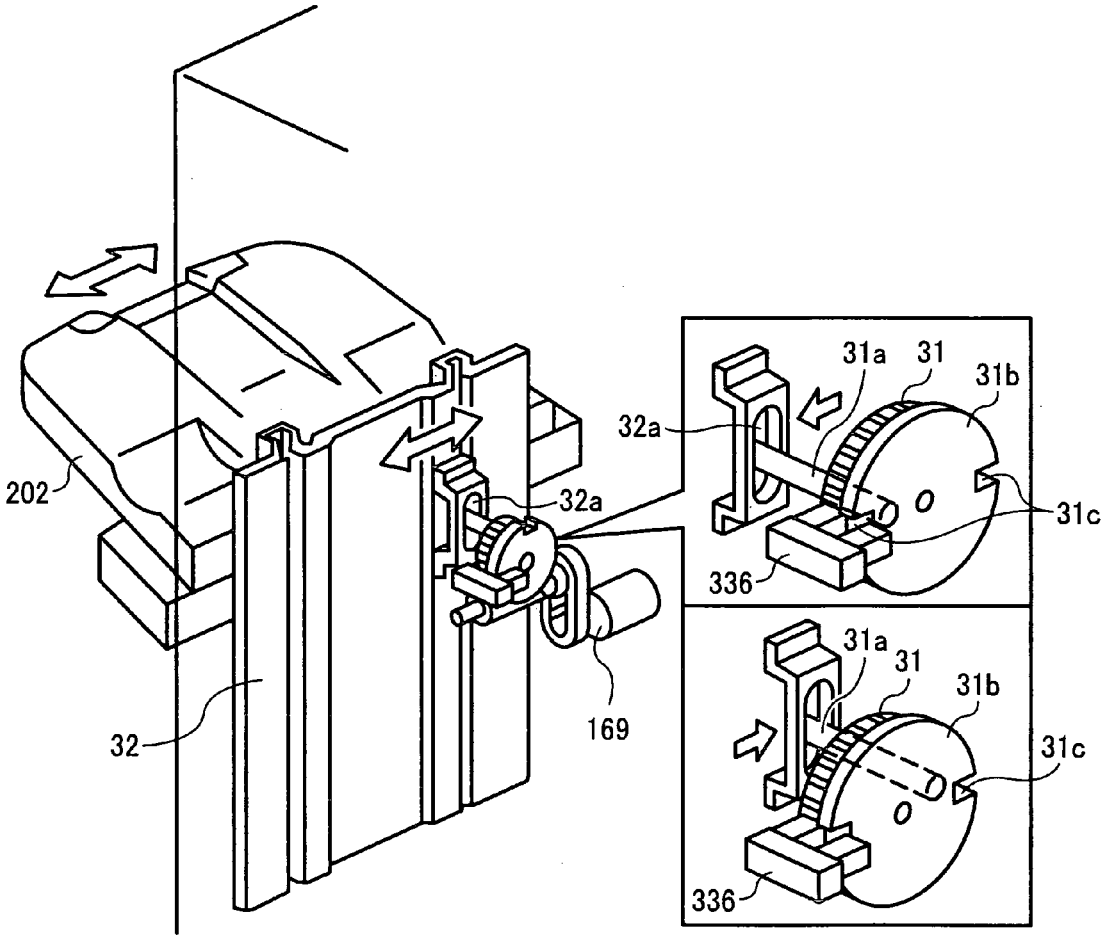
FIG. 2 is a perspective view of an oscillation mechanism of a shift tray used in a sheet post-processing unit device in the image forming apparatus according to the embodiment of the present invention.

As shown in FIG. 2, an oscillating mechanism of the shift tray 202 rotates a shift cam 31 by using a shift motor 169 as a driving source. A pin 31*a* is placed on the shift cam 31 at a position away from a center of a rotary shaft by a fixed distance, and the pin 31*a* is fitted in a long hole portion 32*a* in the non-depicted end fence 32 that is fitted in a direction orthogonal to the sheet discharging direction. The end fence fitted with the pin 31*a* moves in the direction orthogonal to the sheet discharging direction with rotation of the shift cam 31, and the shift tray 202 also moves based on this movement. The shift tray 202 stops at two positions, i.e., a front position and an inner position, and the shift tray 202 stops at these position when a concave portion 31*c* of a detection plate 31*b* that rotates with the shift cam 31 is detected by a shift sensor 336 and the shift motor 169 is turned on or off.

Figure 4:
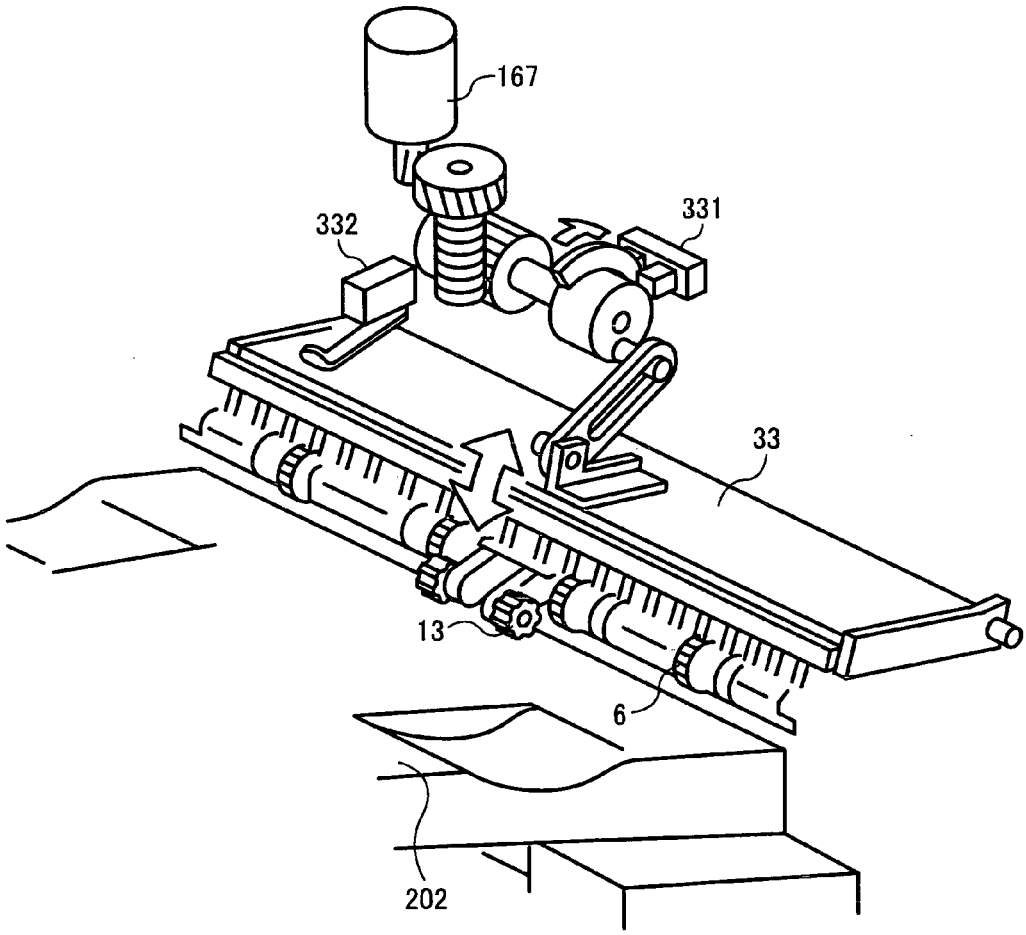
FIG. 4 is a perspective view of a swiveling mechanism of an opening/closing guide plate used in the sheet post-processing unit device in the image forming apparatus according to the embodiment of the present invention.

The shift paper discharge rollers 6 have a driving roller 6*a* and a driven roller 6*b*, and the driven roller 6*b* is supported on an upstream side in the sheet discharging direction and supported to allow its swiveling motion by a free end of an opening/closing guide plate 33 provided to freely swivel in the vertical direction as shown in FIGS. 1 and 4. The driven roller 6*b* comes into contact with the driving roller 6*a* by its own weight or an urging force, and the sheet P is held between both the rollers 6*a* and 6*b* and then discharged. When the bound sheet bundle PB is discharged, the opening/closing guide plate 33 swivels upwards and is returned at a predetermined timing, and this timing is determined based on a detection signal from a shift paper discharge sensor 303. A stop position of the opening/closing guide plate 33 is determined based on a detection timing from a paper discharge guide plate opening/closing sensor 331, and the opening/closing guide plate 33 is driven by a paper discharge guide plate opening/closing motor 167.

As explained above, the shift tray 202 is oscillated in a lateral direction, and the sheet P or the sheet bundle PB stacked on the shift tray 202 can be shifted, laminated, and appropriately sorted according to a predetermined number of sheets or a predetermined number of copies.

(2) Sheet Alignment, Staple Processing

When stacking the sheet P carried via the conveying path D on the processing tray F to produce the sheet bundle PB, in subsequent staple processing at the end or the center of the sheet bundle PB or centerfold processing at the center of the sheet bundle PB, staking the sheets P in a state where a front end or a rear end of the sheet bundle PB is aligned is desirable to accurately perform such processing, and effecting this alignment processing will now be explained.

<Sheet Alignment Processing>

Figure 5:
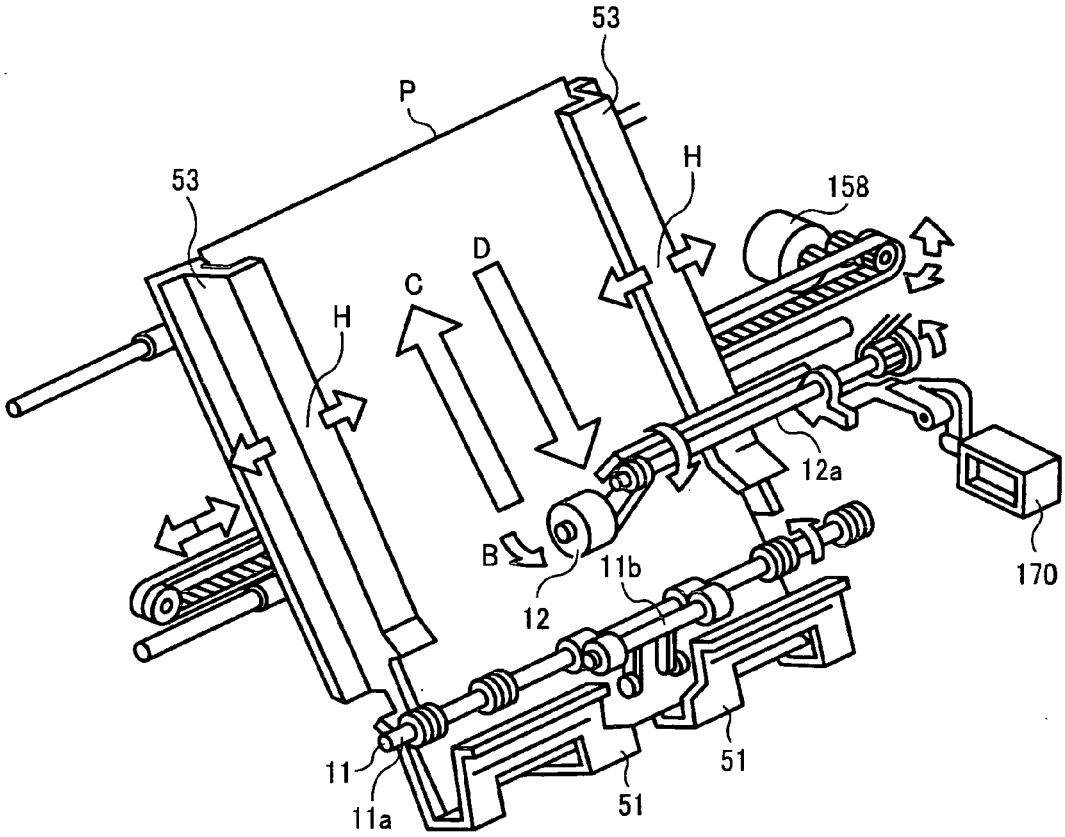
FIG. 5 is a perspective view of a mechanism of a processing tray F used in the sheet post-processing unit device in the image forming apparatus according to the embodiment of the present invention.
Figure 6:
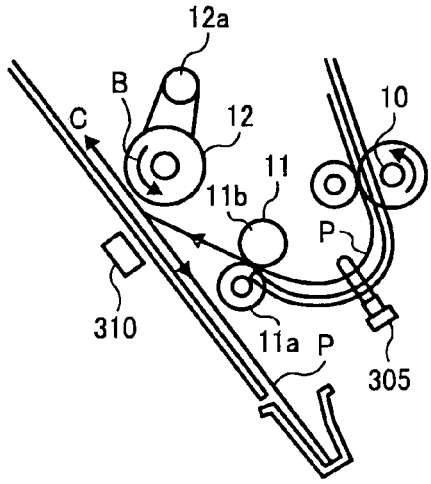
FIG. 6 is a side view of a sheet distribution state depicted in FIG. 5.
Figure 7:
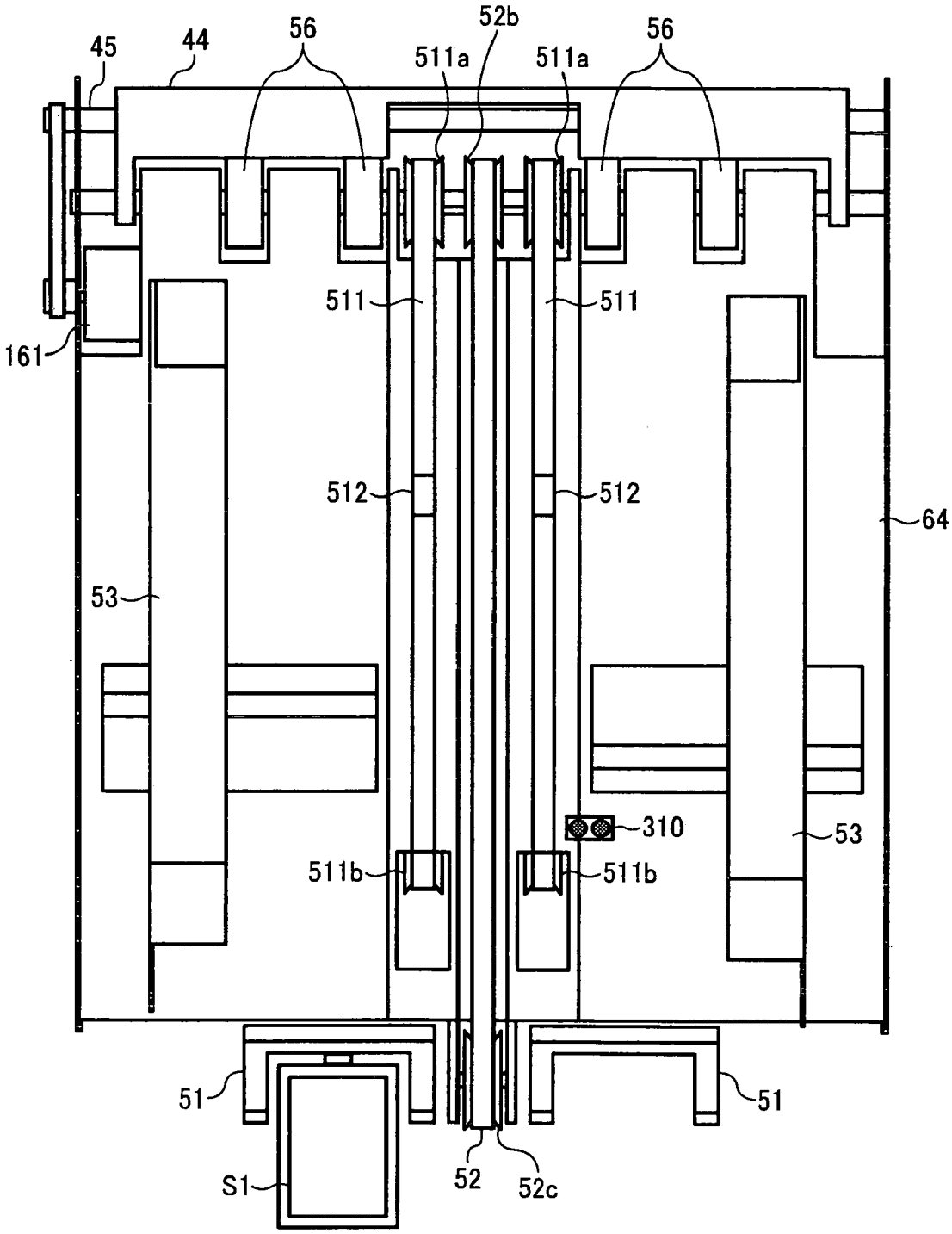
FIG. 7 is a front view excluding a sheet P, a tapping runner, and a staple paper discharge roller in FIG. 5.

A structure of the processing tray F where staple processing is carried out will now be explained with reference to FIGS. 5 to 10. As shown in FIGS. 5 and 6, the sheet P held and carried by a driving roller a and a driven roller 22*b* of the staple paper discharge roller 11 moves up in a direction indicated by an arrow C along a substrate 64 of the processing tray F, the conveying direction is changed from the direction indicated by the arrow C to a direction indicated by an arrow D by a weight of the sheet P, and the sheet P is sequentially laminated and stacked in each rear end fence 51 of the processing tray F. In this case, when aligning the sheets P that have different sheet lengths because, e.g., different sizes are mixed, alignment in the vertical direction (sheet conveying direction) is carried out by using a tapping runner 12 as shown in FIG. 5. A tapping solenoid (SOL) 170 gives a pendulum's motion to the tapping runner 12 with a supporting point 12*a* at the center, and the tapping runner 12 intermittently acts on the sheet supplied to the processing tray F to bring the sheet into contact with each rear end fence 51. It is to be noted that the tapping runner 12 rotates in a counterclockwise direction (direction indicated by an arrow B). As shown in FIG. 7, the thus stacked sheet bundle PB is aligned in the vertical direction (sheet conveying direction) by two front end tappers 512 provided to two front end tapping belts 511 disposed in parallel to interpose a conveying belt 52 that conveys the aligned sheet bundle PB upwards therebetween, and aligned in a lateral direction (sheet width direction orthogonal to the sheet conveying direction) by each jogger fence 53.

As shown in FIGS. 7 and 8, the conveying belt 52 is endlessly formed, has two discharge claws 52*a* that hold the sheet bundle PD and convey it upward (conveying direction) disposed on a surface thereof at a predetermined interval, and is wound around a driving pulley 52*b* and a driven pulley 52*c*. Therefore, with rotation of the driving pulley 52*b*, the conveying belt 52 moves in a conveying path J along a direction indicated by an arrow E, and the discharge claws 52*a* also move in the conveying path J along the direction E to convey the sheet bundle PB upwards.

On the other hand, each front end tapping belt 511 is also endlessly formed, has two front end tappers 512 that align a front end P1 of the sheets P disposed on a surface thereof at a predetermined interval, and is wound around a driving pulley 511*a* and a driven pulley 511*b* that are rotated and driven by a non-depicted motor. In this case, the respective front end tappers 512 disposed to the two front end tapping belts 511 are attached at the same positions of the front end tapping belts 511 in a moving direction, and the front end P1 of the sheets P can uniformly come into contact with the front end tappers 512 at the time of contact. The front end tapping belt 511 moves in a direction indicated by an arrow F (see FIGS. 8B and 8D) and a direction G (see FIGS. 8A and 8F) based on rotation of the driving pulley 511*a*, and each front end tapper 512 also moves in the direction indicated by the arrow F and the direction G with this movement of the front end tapping belt 511.

As shown in FIGS. 8A to 8F, in regard to operations of the discharge claw 52*a* and the front end tapper 512, the front end P1 of the sheet P is moved in the direction G by the front end tapper 512, a rear end P2 of the sheet P is bought into contact with the rear end fence 51, thereby aligning a front end PB1 and a rear end PB2 of the sheet bundle PB (aligned state). During this operation, each discharge claw 52*a* is retracted from the conveying path J of the sheet bundle PB (see FIG. 8A). When alignment of the front end PB1 of the sheet bundle PB by each front end tapper 512 is completed, the front end tapper 512 moves up (direction indicated by the arrow F) with the movement of each front end tapping belt 511, swivels to a rear side of the conveying path J for the sheet bundle PB, and stops at a first predetermined position to be retracted from the conveying path J for the sheet bundle PB (see FIG. 8B). Subsequently, in a state where each front end tapper 512 is stopped at the first predetermined position, a discharge belt 52 (see FIG. 7) wound around the two rear end fences 51 swivels, and each discharge claw 52*a* holds the rear end PB2 of the sheet bundle PB stacked on the rear end fences 51 and conveys the sheet bundle PB to an upper side (direction indicated by an arrow E) of the conveying path J (see FIG. 8C).

Figure 8A:
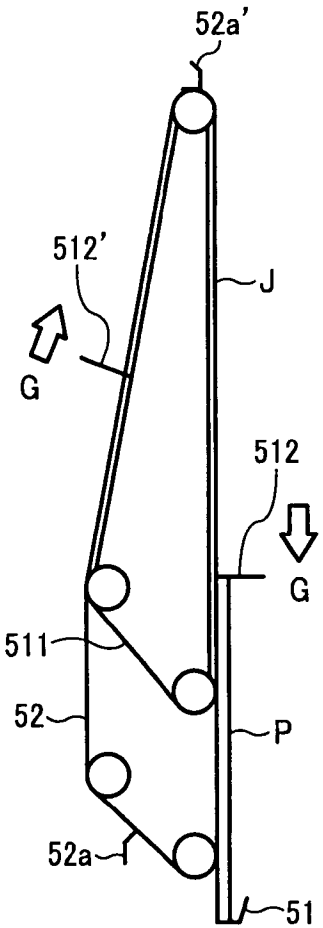
FIGS. 8A to 8F are views of an arrangement relationship between a front end tapper and a discharge claw used in the sheet post-processing unit device in the image forming apparatus according to the embodiment of the present invention, where
Figure 8B:
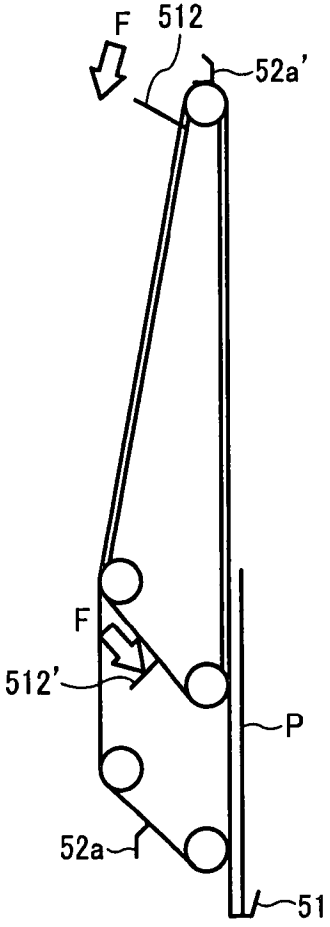
Figure 8C:
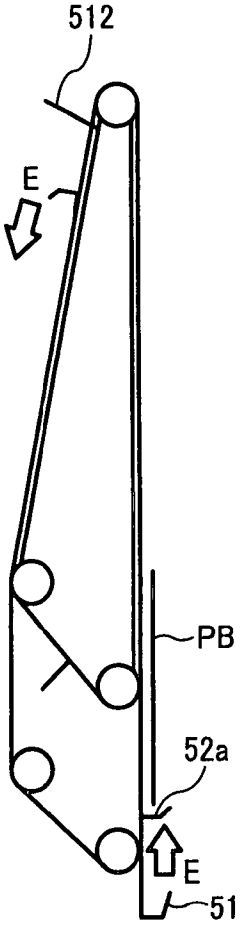
Figure 8F:
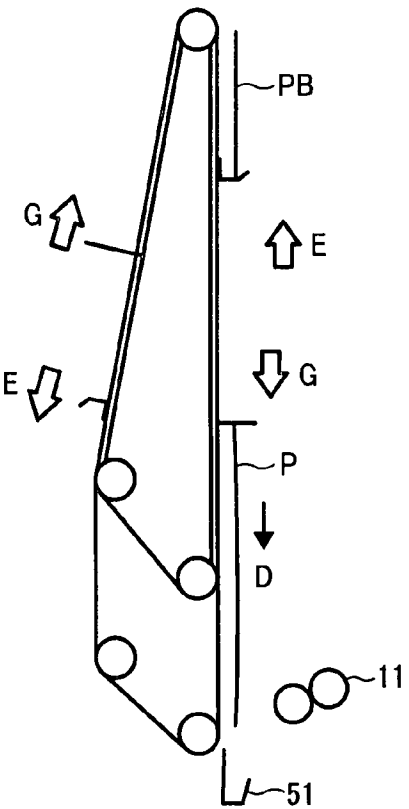
Figure 8E:
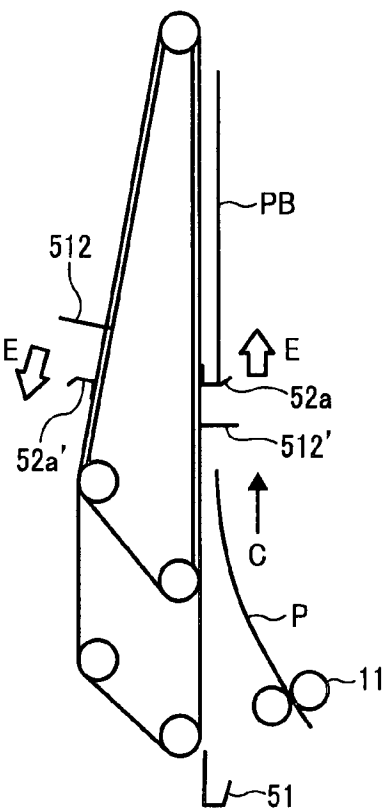
Figure 8D:
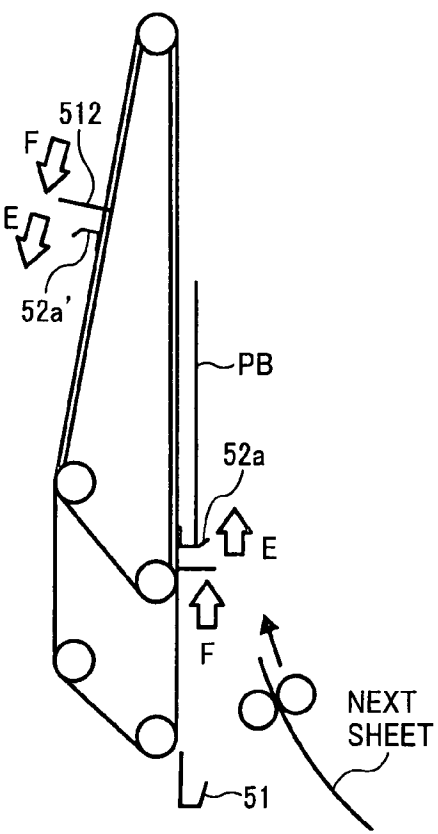

Then, when each discharge claw 52*a* holding the sheet bundle PB moves up in the conveying path J and passes through a second predetermined position, each front end tapper 512 starts movement in the direction F, comes out in the conveying path J from a retracted position in the conveying path J, and moves up (direction indicated by the arrow F) in the conveying path J to follow each discharge claw 52*a* (see FIG. 8D). In this case, because an elevating speed of each front end tapper 512 is set to equal to or lower than an elevating speed of each discharge claw 52*a*, the front end tapper 512 can be prevented from colliding with the discharge claw 52*a*. Although the discharge claw 52*a* continues moving up (direction indicated by the arrow F) in the conveying path J, the front end tapper 512 stops elevation when it reaches a predetermined third position (see FIG. 8E). In this case, this third position is equal to or larger than an acceptable sheet size, thereby improving productivity of the sheet bundles PB of all sizes. When this movement of the front end tapper 512 stops, the sheet P carried from the conveying path D begins to be discharged into the processing tray F by the staple paper discharge rollers 11 (see FIG. 8E). The discharge claw 52*a* moves up in the conveying path J and, on the other hand, the front end tapper 512 stopped at the predetermined third position comes into contact with the front end P1 of the sheet P discharged by the staple paper discharge rollers 11, thus avoiding elevation of the sheet P (see FIG. 8E). The front end tapper 512 further moves down (direction indicated by the arrow G) to a fourth predetermined position (see FIG. 8A) in the conveying path J, moves the sheet P in the direction D (see FIG. 6), and brings the rear end P2 of the sheet P into contact with each rear end fence 51. This operation is continued until a predetermined number of sheets P are discharged from the staple paper discharge rollers 11 and a predetermined number of sheets P are stacked in the rear end fences 51. When the predetermined number of sheets P are stacked in the rear end fences 51 and the sheet bundle having the aligned front and rear ends is produced, the rear end of the sheet bundle PB is stapled as will be explained later, the operations of each discharge claw 52*a* and each front end tapper 512 depicted in FIG. 8B are started, and the operation depicted in FIG. 8C and subsequent operations are sequentially repeated.

As explained above, in an interval between jobs, i.e., between a last sheet in the sheet bundle PB and a top sheet in the next sheet bundle PB, each front end tapper 512 is retracted to a home position (first position) on a rear surface side of the processing tray F, and the facet binding stapler S1 is driven based on a staple signal from a controlling unit 350, thereby performing binding processing. The bound sheet bundle PB is immediately supplied to the shift paper discharge rollers 6 by the discharge belt 52 having the discharge claw 52*a* to be discharged to the shift tray 202 set at a receiving position. At this time, each front end tapper 512 moves to a receiving position for the next sheet to follow the discharge claw 52*a*.

Figure 9:
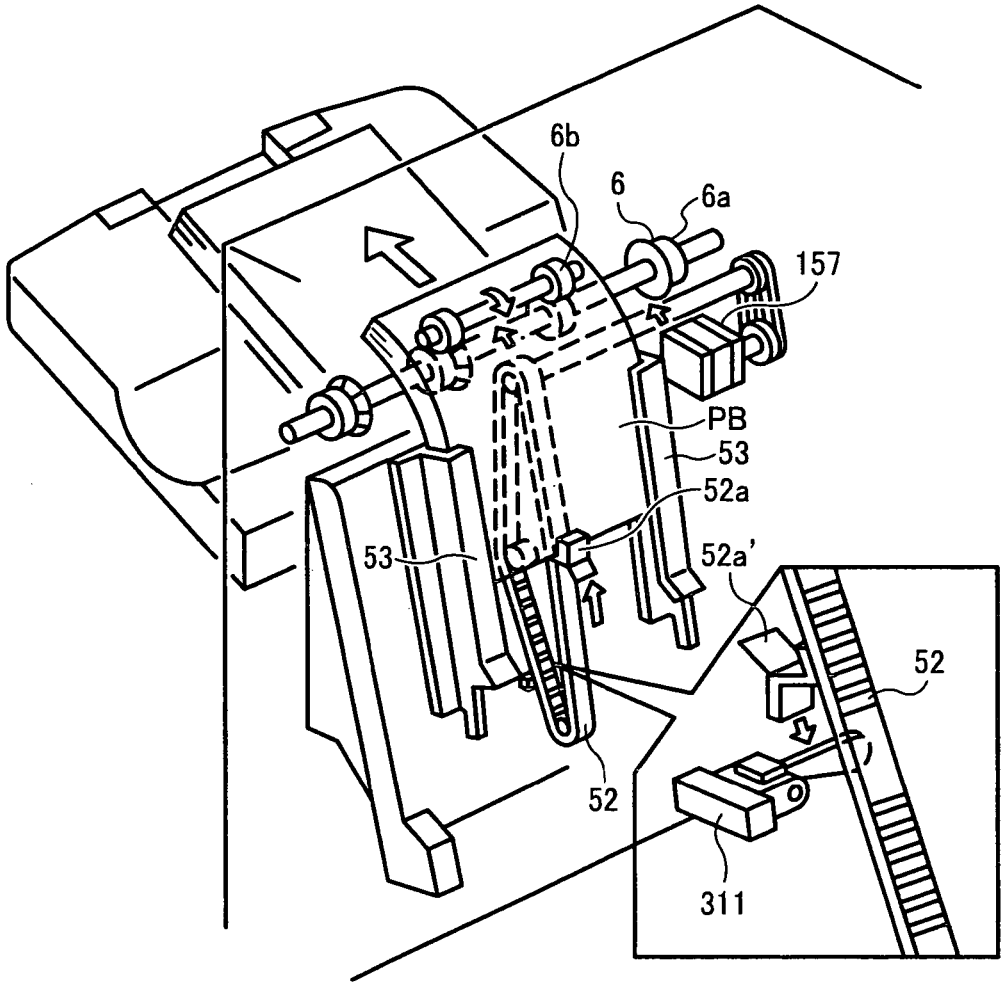
FIG. 9 is a perspective view of a driving mechanism of a discharge belt used in the sheet post-processing unit device in the image forming apparatus according to the embodiment of the present invention.

As shown in FIG. 9, a home position of the discharge claw 52*a* is detected by a discharge belt HP sensor 311, and this discharge belt HP sensor 311 is turned on/off based on the discharge claw 52*a* provided on the discharge belt 52. The two discharge claws 52*a* are arranged at positions opposite to each other on an outer periphery of the discharge belt 52 to alternately move and convey the sheet bundle PB accommodated in the processing tray F. As shown in FIG. 7, the discharge belt 52 is arranged at the center of alignment in the sheet width direction and driven by a discharge motor 157 via a driving shaft and a pulley. Discharge rollers 56 are arranged and fixed at symmetrical positions with the discharge belt 52 at the center, and a circumferential speed of the discharge rollers 56 is set to be higher than that of the discharge belt 52.

A home position of each front end tapping belt 511 is also detected by a non-illustrated sensor like the discharge belt HP sensor 311. The two front end tappers 512 are arranged at positions opposite to each other on the outer periphery of each front end tapping belt 511 and alternately perform alignment in the vertical direction with respect to each sheet bundle accommodated in the processing tray F. An interval between the front end tappers 512 is equal to or smaller than a lateral size of an acceptable minimum sheet, thus assuredly performing alignment in the vertical direction.

Figure 10A:
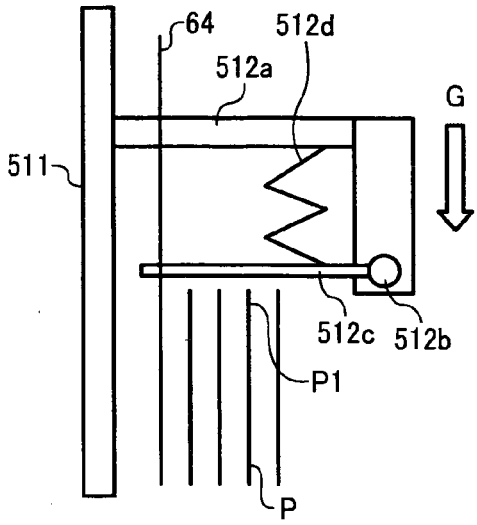
FIGS. 10A and 10B are side views of a mechanism of the front end tapper used in the sheet post-processing unit device in the image forming apparatus according to the embodiment of the present invention, where
Figure 10B:
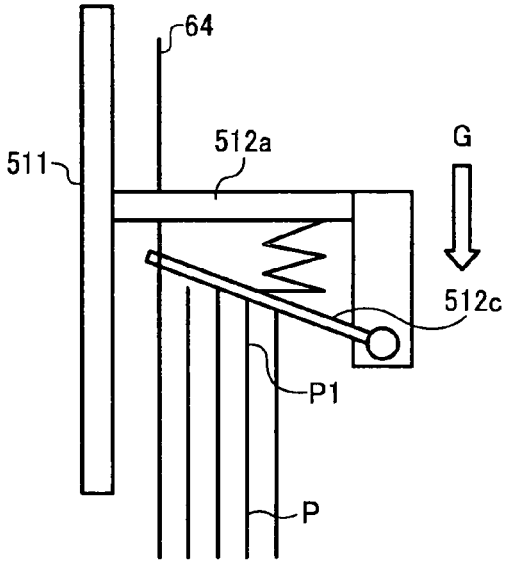

As shown in FIGS. 10A and 10B, a supporting point 512*b* is provided at a distal end of the support 512*a* that is disposed at a predetermined position on the front end tapping belt 511 and has an L-shaped cross section, a front end tapper 512*c* is disposed so as to freely swivel around this supporting point 512*b*, and a pressing unit 512*d* made of an elastic member, e.g., a spring is disposed between the support 512*a* and the front end tapper 512*c*. Therefore, as explained with reference to FIGS. 8A and 8F, the front end P1 of the sheet P discharged from the staple paper discharge rollers 11 comes into contact with the front end tapper 512*c*, and the front end tapper 512 is moved down in the direction indicated by the arrow G to bring the rear end P2 of the sheet P into contact with the rear end fence 51. At this moment, as shown in FIG. 10B, the front end tapper 512*c* swivels upwards against an elastic force of the pressing member 512*d* to press the sheet P toward the substrate 64 side of the processing tray F, thereby aligning the front end P1 of the sheet P. Therefore, the front end P1 of the sheet P hardly comes off the front end tapper 512*c*, thus enabling appropriate alignment of the front end.

An example where a side end of the sheet P is aligned by each jogger fence 53 (alignment in the lateral direction) will now be explained. As shown in FIG. 5, the jogger fence 53 is driven through a timing belt by a jogger motor 158 rotatable in both forward and backward directions to reciprocate in the sheet width direction (direction indicated by an arrow H). Therefore, each jogger fence 53 waits with a width wider than the width of the sheet P to be carried based on a signal indicative of a sheet size from the image forming unit device PR or a signal indicative of a sheet size detected by the sheet post-processing unit device PD. When the sheet P is carried to the processing tray F, the jogger fences 53 are moved to narrow a distance between the jogger fences 53 and align the side ends of the sheet P put in the processing tray F.

<Pressing Rear End of Sheet Bundle>

A mechanism that presses a bulge of the rear end of the sheet bundle stacked in the processing tray F will now be explained with reference to FIG. 11. The sheet P discharged into the processing tray F is aligned in the vertical direction (sheet conveying direction) by the front end tapper 512 with respect to each sheet P as explained above. However, when the sheet rear end P2 stacked in the processing tray F is curled or its rigidity is weak, the rear end tends to be buckled and bulge due to a weight of the sheet itself. When the number of stacked sheets is increased, a space in each rear end fence 51 where the next sheet P is to enter is reduced, and alignment in the vertical direction tends to be degraded. A rear end presser lever 110 depicted in FIG. 11 reduces the bulge of the sheet rear end P2 to facilitate ingression of the sheet P into each rear end fence 51, and this rear end presser lever 110 can move back and forth along a direction indicated by an arrow I.

Figure 11:
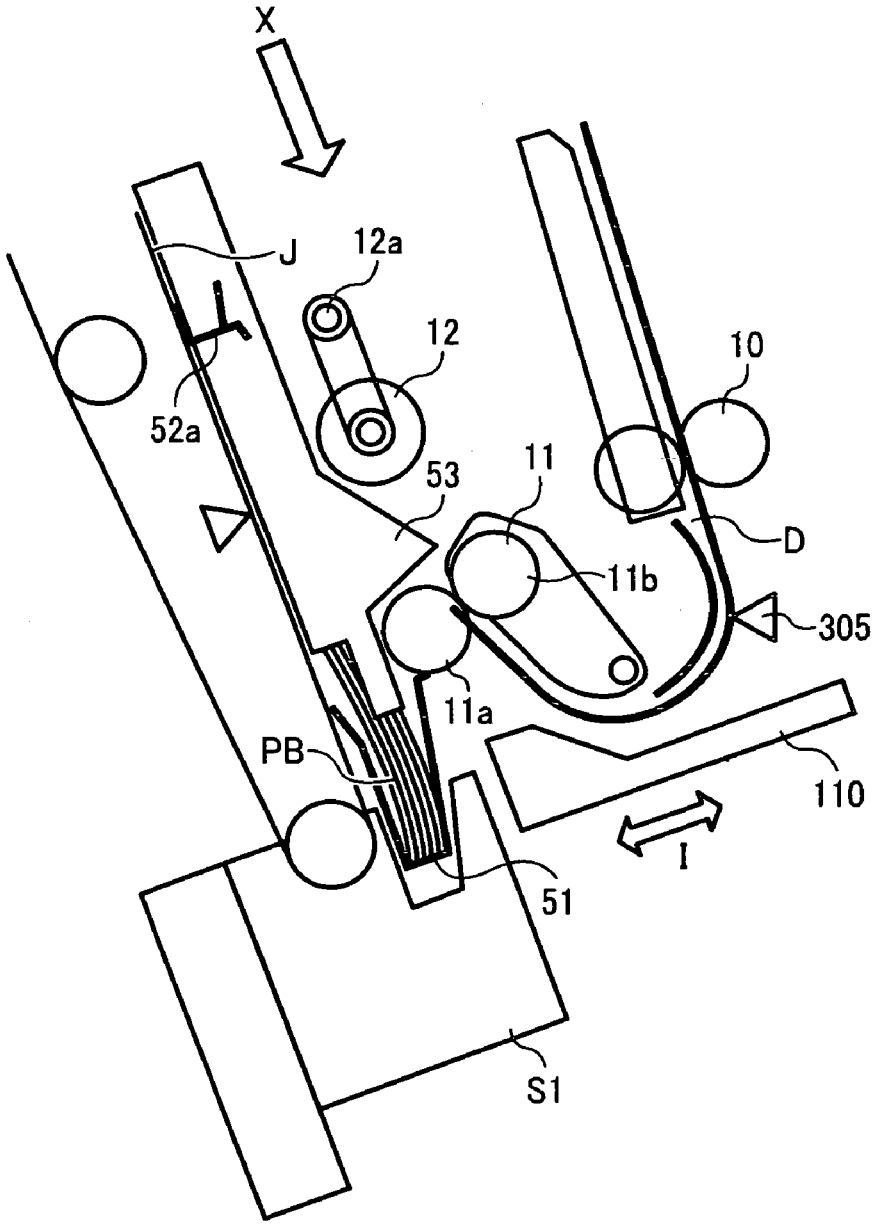
FIG. 11 is a side view of a mechanism of a rear end presser lever used in the sheet post-processing unit device in the image forming apparatus according to the embodiment of the present invention.
Figure 12A:
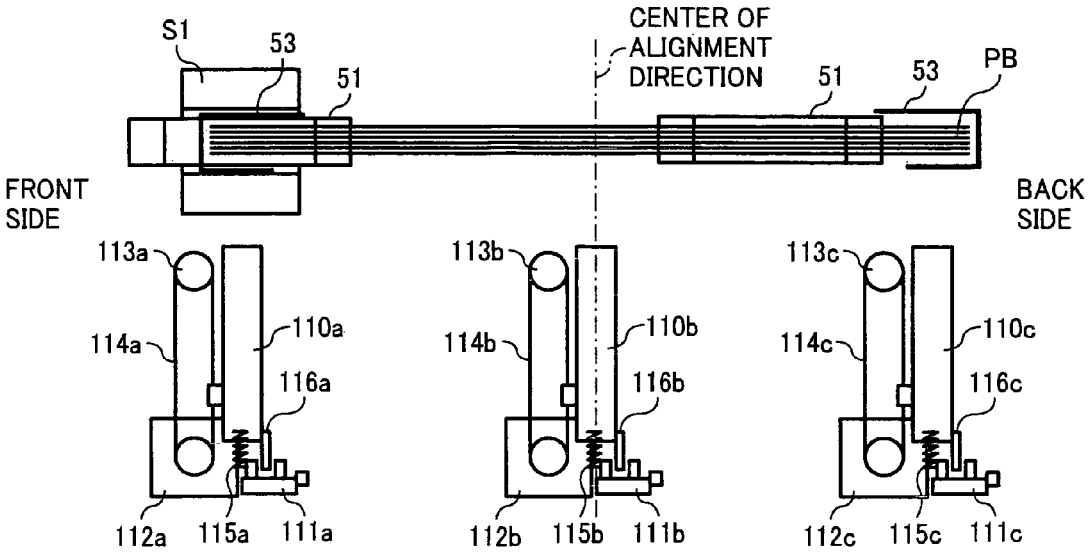
FIGS. 12A and 12B are views of an arrangement relationship between the rear end presser lever and a stapler as seen from an X direction in FIG. 11, where
Figure 12B:
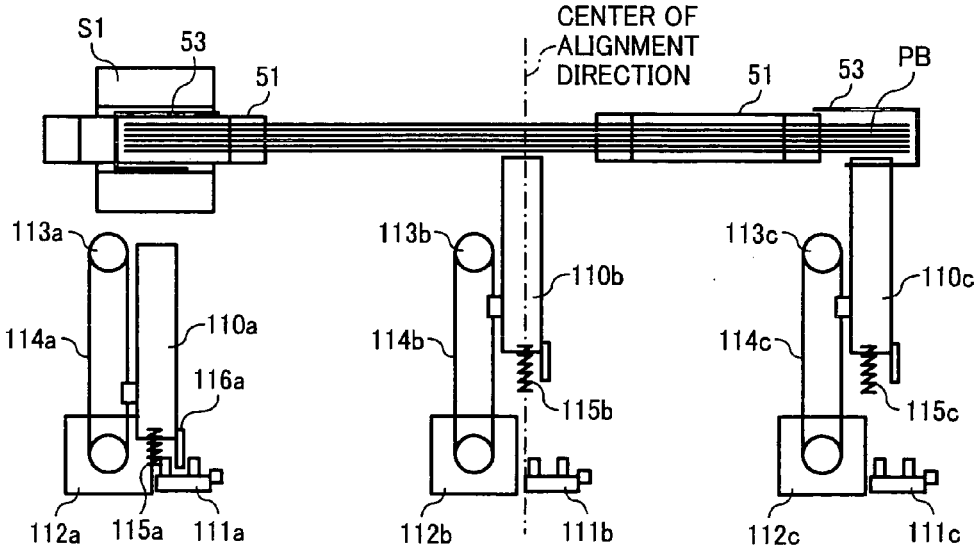
Figure 13A:
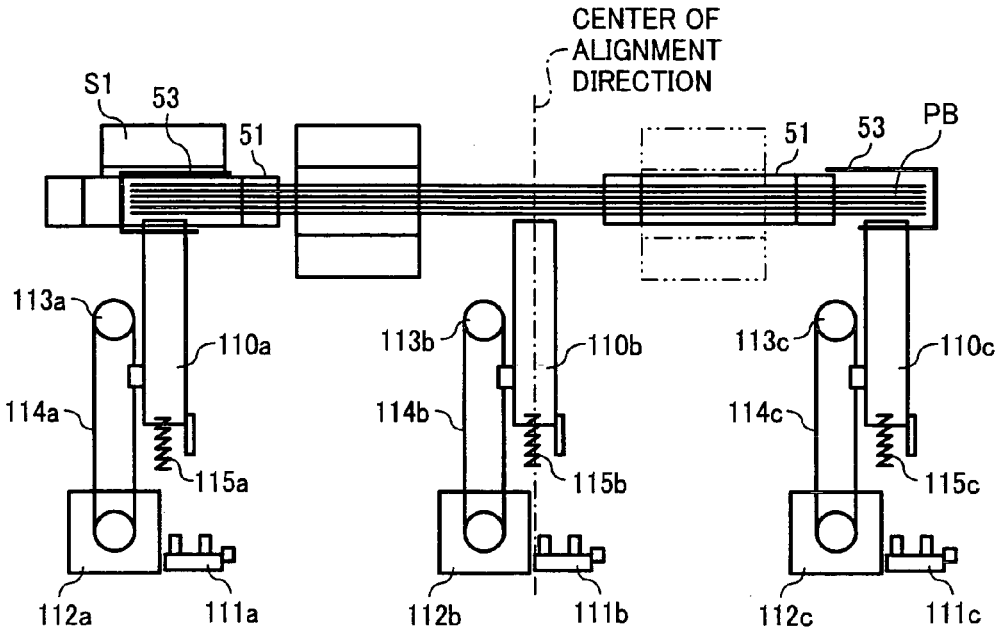
FIGS. 13A and 13B are views of an arrangement relationship between the rear end presser lever and the stapler depicted in FIGS. 12A and 12B, where
Figure 13B:
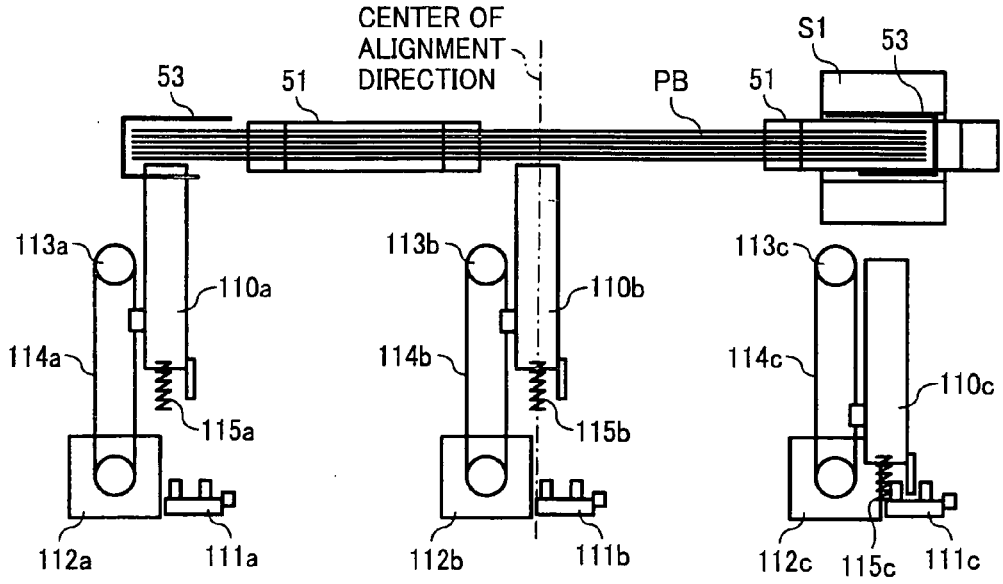
Figure 14:
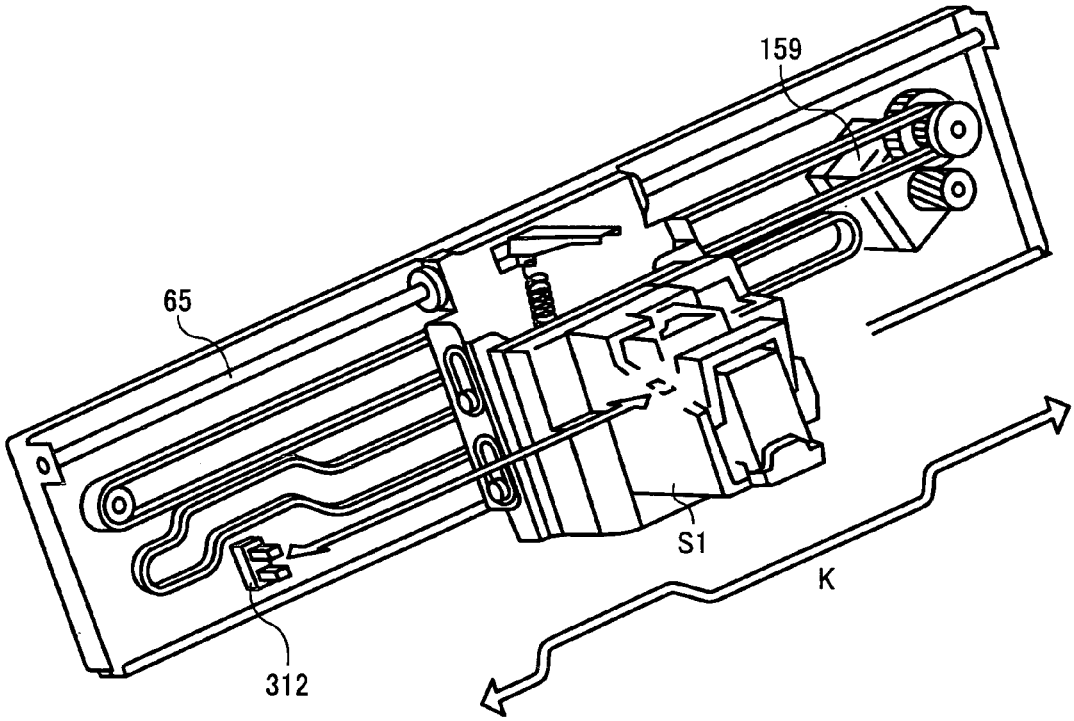
FIG. 14 is a perspective view of a lateral movement mechanism of a stapler used in the sheet post-processing unit device in the image forming apparatus according to the embodiment of the present invention.

FIGS. 12A and 12B and FIGS. 13A and 13B are views of an arrangement relationship and an operational relationship between the sheet bundle PB, the stapler S1, the rear end fences 51, and the rear end presser lever 110 as seen in a direction indicated by an arrow X in FIG. 11. Rear end presser levers 110*a*, 110*b*, and 110*c* that press the rear end PB of the sheet bundle PB held in the rear end fences 51 are arranged at three positions, i.e., a front side of the machine, a center, and an inner side so as to face a surface of the sheet bundle PB. In this example, a mechanism of the rear end presser lever 110*a* on the front side will be explained. First, because the rear end presser lever 110*a* is fixed to a timing belt 114*a* and the timing belt 114*a* is wound around a rear end presser lever motor 112 and a pulley 113, the rear end presser lever 110*a* moves back and forth toward the sheet bundle PB with rotation of the rear end presser lever motor 112. A convex portion 116*a* of the rear end presser lever 110*a* blocks off a home sensor 111*a* to detect a home position. The home position of the rear end presser lever 110*a* is a position that does not interfere with the stapler S1 in a range where the stapler S1 moves in a direction indicated by an arrow K (width direction of the sheet P) as shown in FIG. 14. A moving distance in a direction of pressing the rear end of the sheet bundle PB, i.e., in a direction indicated by an arrow I in FIG. 11 is determined based on an input pulse number with respect to the rear end presser lever motor 112, and a distal end of the rear end presser lever 110*a* moves to a position where it comes into contact with the sheet bundle PB to press the bulge of the sheet bundle rear end PB2. An expanding/contracting motion of a spring 115*a* absorbs and copes with a change in a thickness of the stacked sheet bundle PB. Operations of the rear end presser levers 110*b* and 110*c* are equal to that of the rear end presser lever 110*a*.

Operations of the rear end presser levers 110*a*, 110*b*, and 110*c* in each binding mode will now be explained. FIG. 12B depicts a standby position of the stapler S1 in front binding, FIG. 13A depicts that in two-position binding, and FIG. 13B depicts that in inner binding. At each standby position, an interference with the stapler S1 must be avoided when the rear end presser lever 110 is operated. The rear end presser levers 110*b* and 110*c* can be operated in front binding, the rear end presser levers 110*a*, 110*b*, and 110*c* can be operated in two-position binding, and the rear end presser levers 110*a* and 110*b* can be operated in inner binding. FIGS. 12B to 12D depict operating positions of the rear end presser levers in the respective binding modes. In regard to an operation timing, the operation is carried out after the discharged sheet is stacked in each rear end fence 51 to be aligned in the sheet width direction by each jogger fence 53 and before the next sheet is aligned by each front end tapper 512 or the tapping runner 12.

<Stapler Binding>

Figure 15:
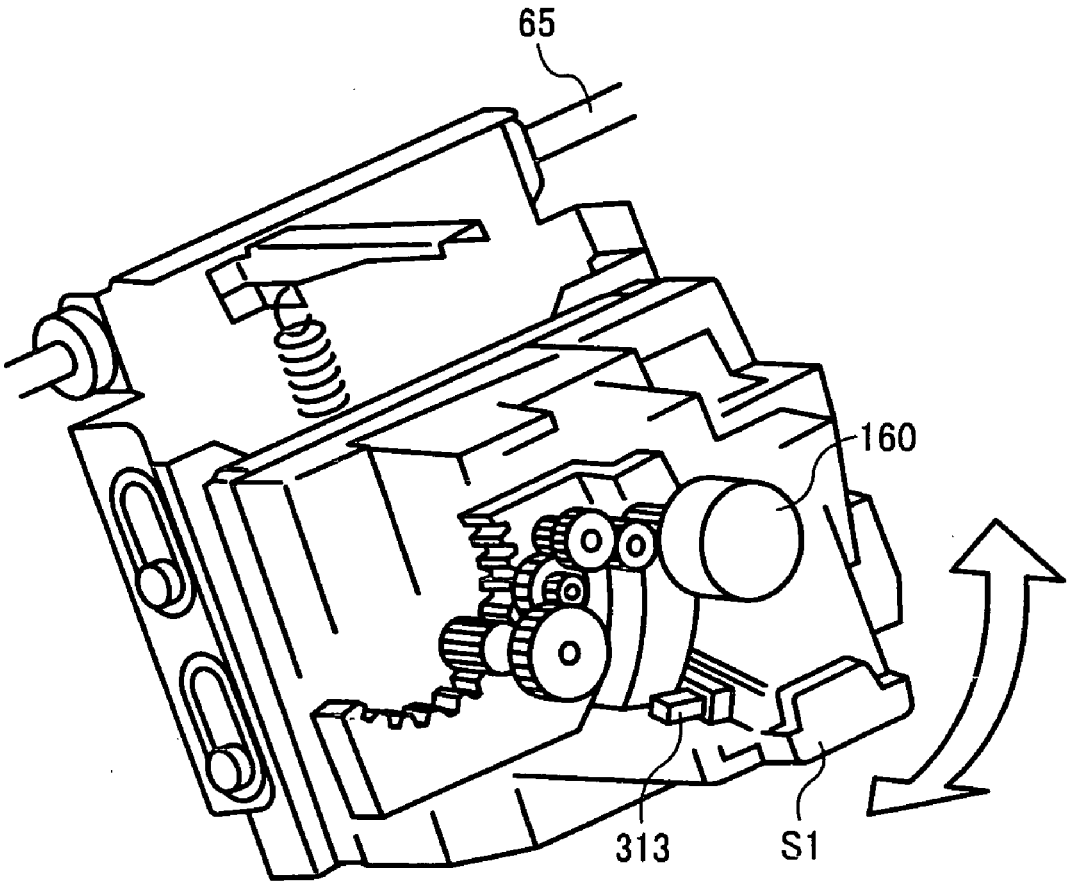
FIG. 15 is a perspective view of a swiveling mechanism of the stapler depicted in FIG. 14.

As explained above, after the front end, the rear end, and the side ends of the sheet bundle PB are aligned in the processing tray F, the aligned sheet bundle PB is subjected to staple binding at the rear end by the facet binding stapler S1, and the stapler S1 that performs this processing will now be explained with reference to FIGS. 14 and 15. As shown in FIG. 14, the facet binding stapler S1 is driven through a timing belt by a stapler moving motor 159 that can rotate both in forward and backward directions, and moves in the sheet width direction along a guide rod 65 to bind the sheet bundle end PB2 at a predetermined position. A stapler movement HP sensor 312 that detects a home position of the facet binding stapler S1 is provided at one side end of a movement range of the facet binding stapler S1, and a binding position in the sheet width direction is controlled based on a moving distance of the facet binding stapler S1 from the home position. As shown in FIG. 15, when obliquely performing staple binding at the sheet bundle rear end PB2, an oblique motor 160, a gear, a pinion, and a rack gear are used to swivel the stapler S1 with respect to the guide rod 65, and a detection sensor 313 is used to carry out inclination at a predetermined angle.

Figure 16:
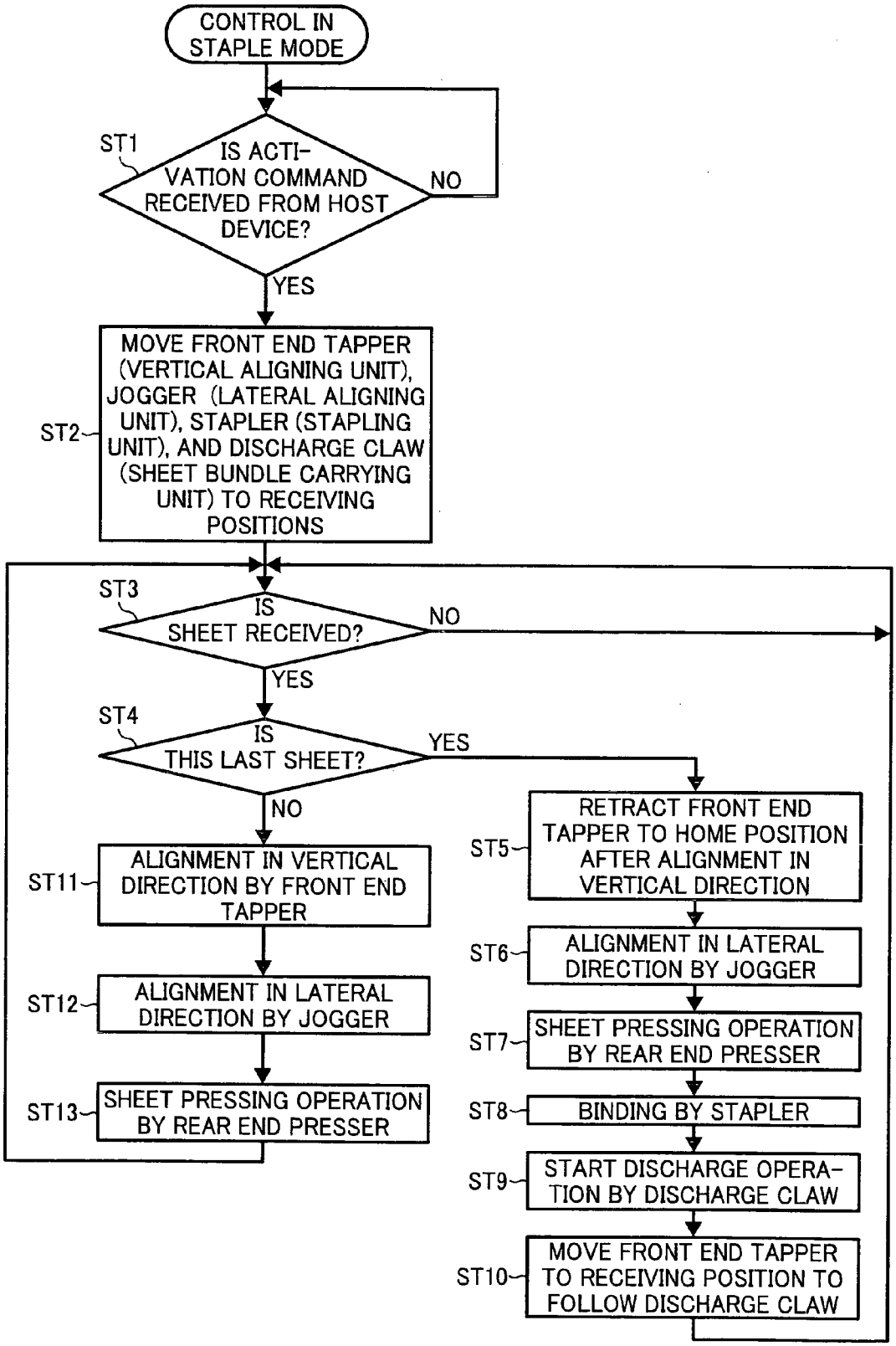
FIG. 16 is a flowchart of alignment and staple processing adopted in the sheet post-processing unit device in the image forming apparatus according to the embodiment of the present invention.

As explained above, according to the sheet post-processing unit device of this embodiment, although the sheet P carried from the conveying path D is stacked in the processing tray F and the front end and the rear end of the sheet P are aligned to produce the sheet bundle PB, these operations are controlled by a later-explained computer, and this flow will now be explained based on a flowchart of FIG. 16. First, whether an activation command is received from a host device is judged (step 1 (ST1)), and the front end tappers 512, the jogger fences 53, the staple S1, and the discharge claws 52*a* are moved to receiving positions when a judgment result is YES (step 2 (ST2)). Subsequently, receiving the sheet P in the processing tray F is started (step 3 (ST3)), then whether the sheet P is a last sheet is judged (step 4 (ST4)), and the front end tappers 512 are retracted to the home position after alignment in the vertical direction when a judgment result is YES (step 5 (ST5)). Then, the jogger fences 53 are used to perform alignment in the lateral direction (step 6 (ST6)), the rear end presser levers 110 press the sheet bundle rear end PB2 (step 7 (ST7)), the stapler S1 binds the sheet bundle PB (step 8 (ST8)), the discharge claws 52*a* start discharging the sheet bundle PB (step 9 (ST9)), and the front end tappers 512 move to the receiving positions so as to follow the discharge claws 52*a* (step 10 (ST10)). Thereafter, the control returns to the step ST3, and the same steps are repeated for a predetermined number of times. On the other hand, when the judgment result is NO at the step ST4, the front end tappers 512 are used to effect alignment in the vertical direction with respect to each sheet P (step 11 (ST11)), the jogger fences 53 are used to perform alignment in the lateral direction (step 12 (ST12)), and the rear end presser levers 110 press the sheet bundle rear end PB 2 (step 13 (ST13)). When the sheet P is the last sheet, this operation returns to the step 5 (ST5), thereby producing the sheet bundle PB subjected to staple binding.

It is to be noted that staple binding is effected at the rear end of the sheet bundle PB in this embodiment, but alignment processing for the sheet bundle PB alone is performed without carrying out staple binding processing at the rear end when performing, e.g., saddle stitching or centerfolding. Although alignment at the front end, the rear end, and the side ends and in the thickness direction of the sheet bundle PB is carried out as alignment processing in this embodiment, all of these alignments do not have to be performed, and aligning at least the front end and the rear end of the sheet bundle PB can suffice.

As explained above, in the sheet processing apparatus according to the present invention, the front end and the rear end of the sheet bundle PB are aligned by using the discharge claws 52*a* and the front end tappers 512 provided separately from the discharge claws 52*a*, the front end tappers 512 are retracted from or protruded to the conveying path J of the sheet bundle PB, and the front end tappers 512 come out from behind the discharge claws 52*a* so as to follow up the discharge claws after movement of the discharge claws 52*a*, thereby reducing a waiting time until the sheet P is put into the processing tray F and improving productivity of the sheet bundle.

When the conveying direction aligning unit follows the sheet bundle, a moving speed of the conveying direction aligning unit is equal to or lower than that of the sheet bundle, and hence the conveying direction aligning unit can be prevented from colliding with the sheet bundle during conveying.

During conveying of the sheet bundle, because the bundle conveying direction aligning unit moving to follow the sheet bundle is stopped at a position where the next sheet is received, the unit can wait to immediately shift to the next sheet aligning operation.

Because the front end tappers bring the sheet in contact with at least the two rear end fences to suppress inclination of the sheet P, thus effecting excellent alignment.

Because a width between the two position where the sheet is brought into contact with the fences by the front end tappers is equal to or smaller than a minimum width of the accepted sheet, thereby assuredly aligning a sheet of a small size.

Because the front end tappers are movable, the front end tappers can recede even if the sheet is extremely pressed, and the sheet can be protected from damages.

Because an elastic member is provided to each front end tapper, the front end tapper can return to a normal position.

Because the front end tappers are movable in a direction of pressing the sheet P toward the staple tray, the sheet P can be assuredly pressed and aligned.

Because the movable range of each front end tapper is equal to or above a sheet size, the sheets of all acceptable sizes can be aligned.

The front end tappers are retracted to the rear side of the conveying path J, thereby improving operability.

In the sheet post-processing unit device according to this embodiment, the sheet bundle PB having the front and the rear end aligned as explained above can be carried from the processing tray F to the saddle stitch or centerfold processing tray G or carried from the processing tray F to the shift tray 202. Changing the conveying direction of the sheet bundle PB will now be explained.

<Changing Carriage Direction of Sheet Bundle>

Figure 17A:
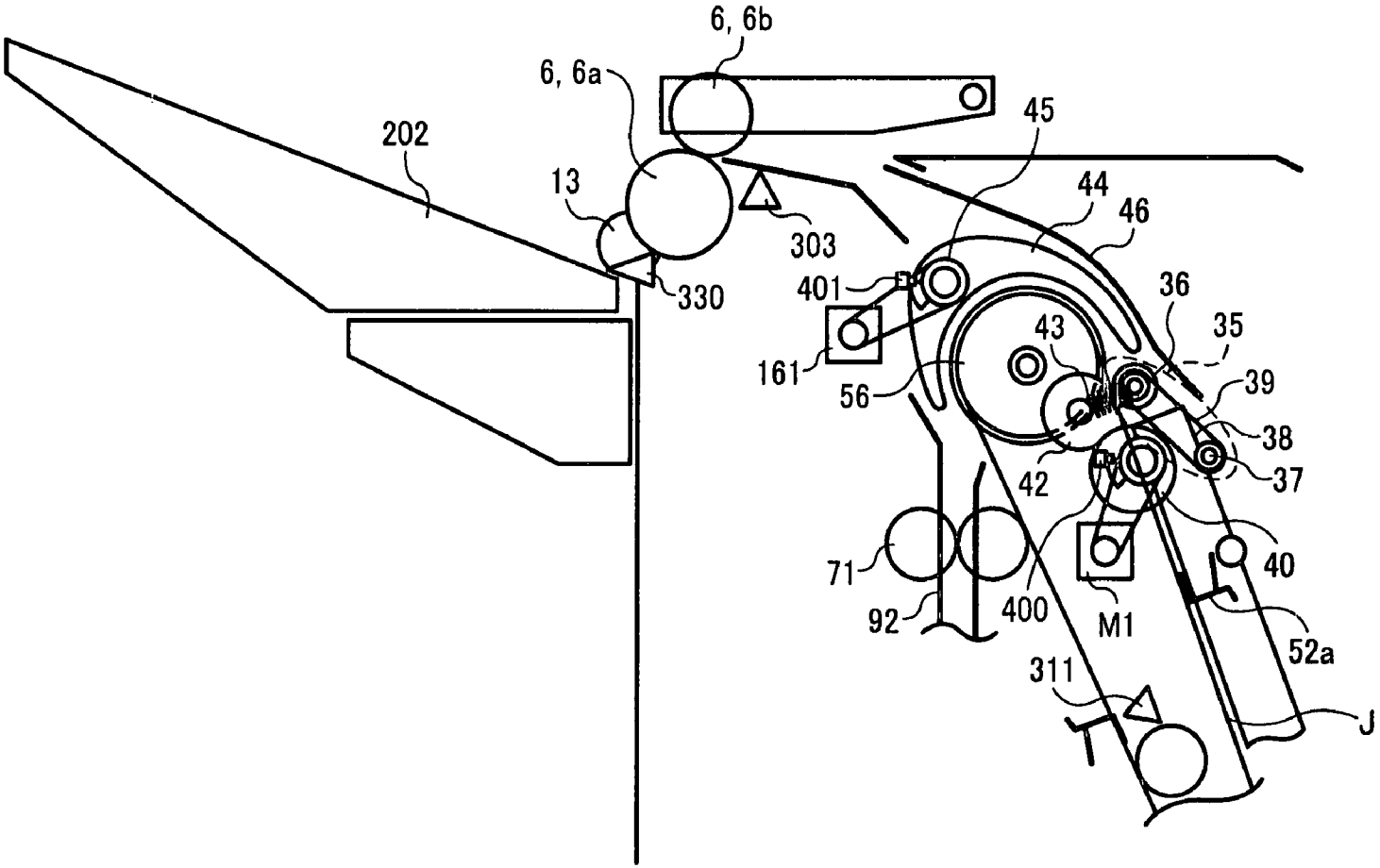
FIGS. 17A and 17B are views of a changing mechanism in a sheet bundle conveying direction used in the sheet post-processing unit device in the image forming apparatus according to the embodiment of the present invention, where

FIGS. 17A and 17B and FIGS. 18A and 18B are views of an outline structure and an operation of a sheet bundle conveying direction changing unit according to this embodiment. As shown in FIG. 17A, the conveying J through which the sheet bungle PB is supplied from the end binding processing tray F depicted in FIG. 1 to the saddle stitch processing tray G or from the end binding processing tray F to the shift tray 202 and a conveying unit that conveys the sheet bundle PB include a conveying unit 35 that gives a conveying force to the sheet bundle PB, the discharge rollers 56 that turn the sheet bundle PB, and the guide member 44 that guides a turned part of the sheet bundle PB. A runner 36 of the conveying unit 35 receives a driving force of a driving shaft 37 through a timing belt 38, the runner 36 and the driving shaft 37 are coupled and supported by an arm 39, and the runner 36 can move with the driving shaft 37 being used as a rotation supporting point. The runner 36 of the conveying unit 35 is rotated and moved by a cam 40, and the cam 40 rotates around a rotary shaft 41 and receives a driving force from a motor M1.

Figure 17B:
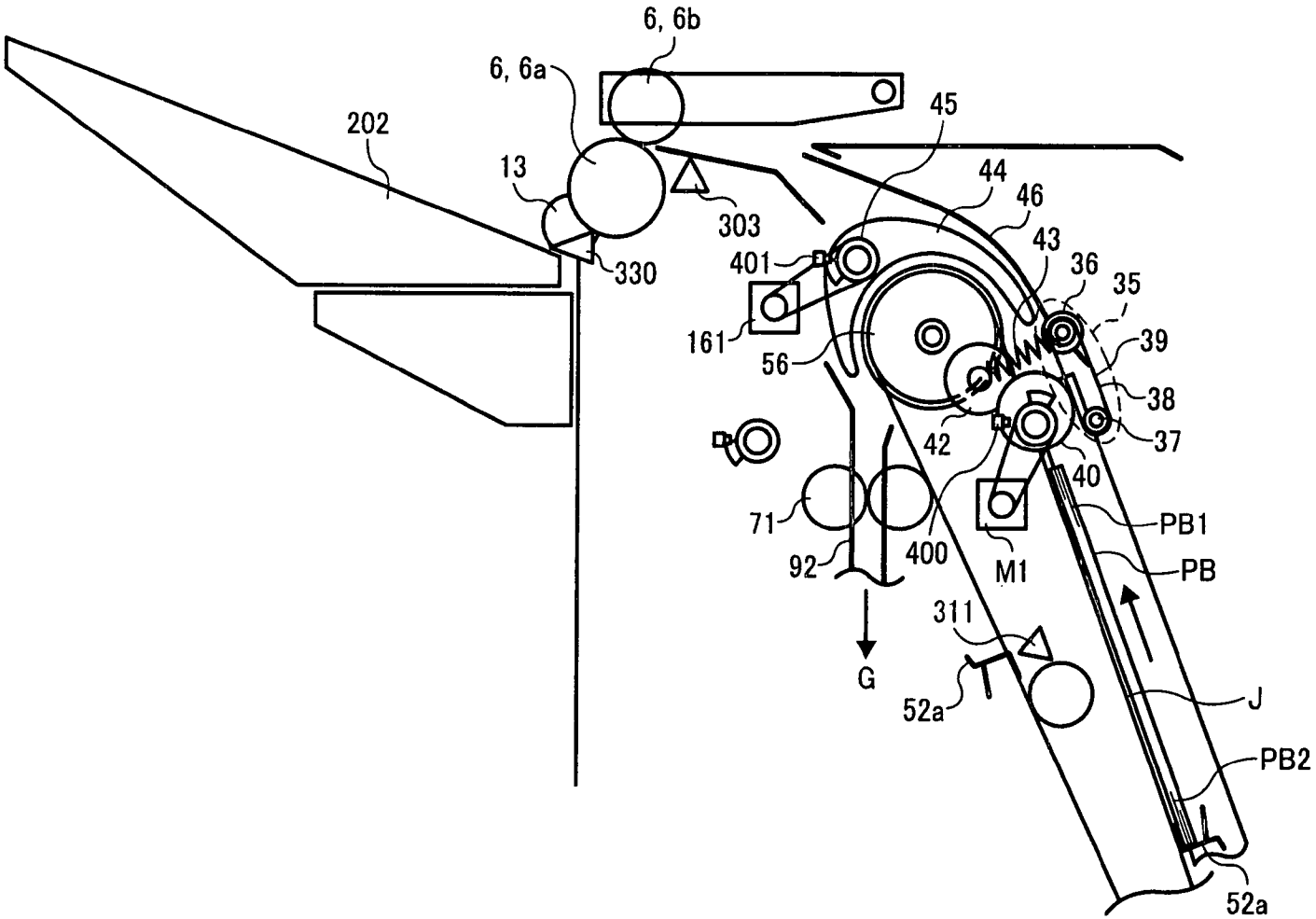
Figure 19:
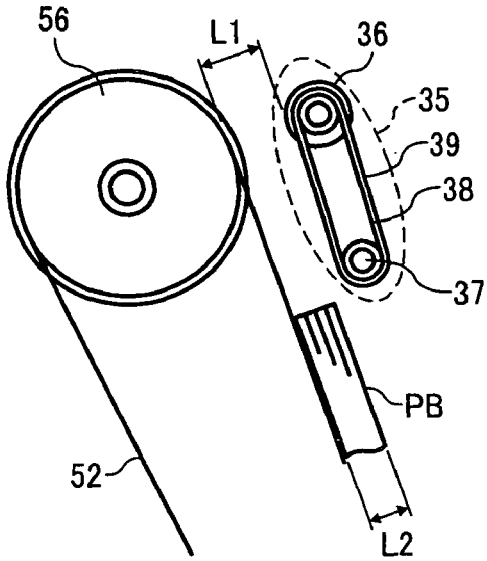
FIG. 19 is a view of a relationship between a thickness of a sheet bundle and a gap between a discharge roller and a pressure runner in a changing mechanism in a sheet bundle conveying direction used in a sheet post-processing unit device in an image forming apparatus according to another embodiment of the present invention.
Figure 20:
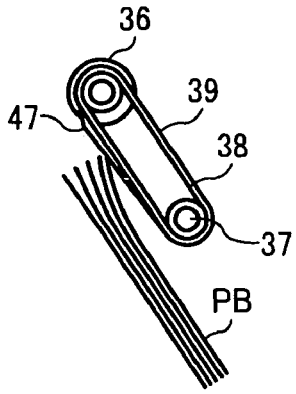
FIG. 20 is a view of a modification of a pressure runner depicted in FIG. 19.

Here, when supplying the sheet bundle PB from the end binding processing tray F to the saddle stitch processing tray G, as shown in FIG. 17B, the discharge claws 52*a* push up the rear end PB2 of the sheet bundle PB aligned in the end binding processing tray F, and the runner 36 of the conveying unit 35 and an opposed driven roller 42 sandwich the sheet bundle PB to give a conveying force. At this time, the runner 36 of the conveying unit 35 waits at a position where the sheet bundle front end PB1 does not come into contact with the runner 36. Here, as shown in FIG. 19, a distance L1 between the runner 36 and a surface where the sheet bundle PB is stacked in the processing tray F at the time of alignment or a surface 64 where the sheet bundle PB is guided when pushed up by the discharge claws 52*a* is set to be wider than a maximum paper thickness L2 of the sheet bundle PB supplied from the end binding processing tray F to the saddle switch processing tray G to avoid collision of the sheet bundle front end PB1 and the runner 36. Because a thickness of the sheet bundle varies depending on the number of sheets or types of sheets to be aligned in the end binding processing tray F, a necessary minimum position where the runner 36 is prevented from colliding with the front end of the sheet bundle also varies. Thus, when a retracting position is fluctuated depending on the number of sheets or types of sheets, a time required to move from the retracting position to a position where the conveying force is given can be also set to a necessary minimum time, which is advantages for productivity of the sheet bundle PB. Information of the number of sheets or types of sheets may be job information from the image forming unit device PR, or it may be obtained by a sensor in the sheet post-processing unit device PD. However, if the sheet bundle PB aligned in the end binding processing tray F is unexpectedly greatly curled, the sheet bundle front end PB1 may possibly come into contact with the runner 36 when the sheet bundle PB is pushed up by the discharge claws 52*a*, and hence a guide 47 must be provided immediately before the runner 36 as shown in FIG. 20 to reduce a contact angle of the sheet bundle front end PB1 and the runner 36. The same effect can be obtained irrespective of a fixed member or an elastic member forming this guide 47.

Figure 18A:
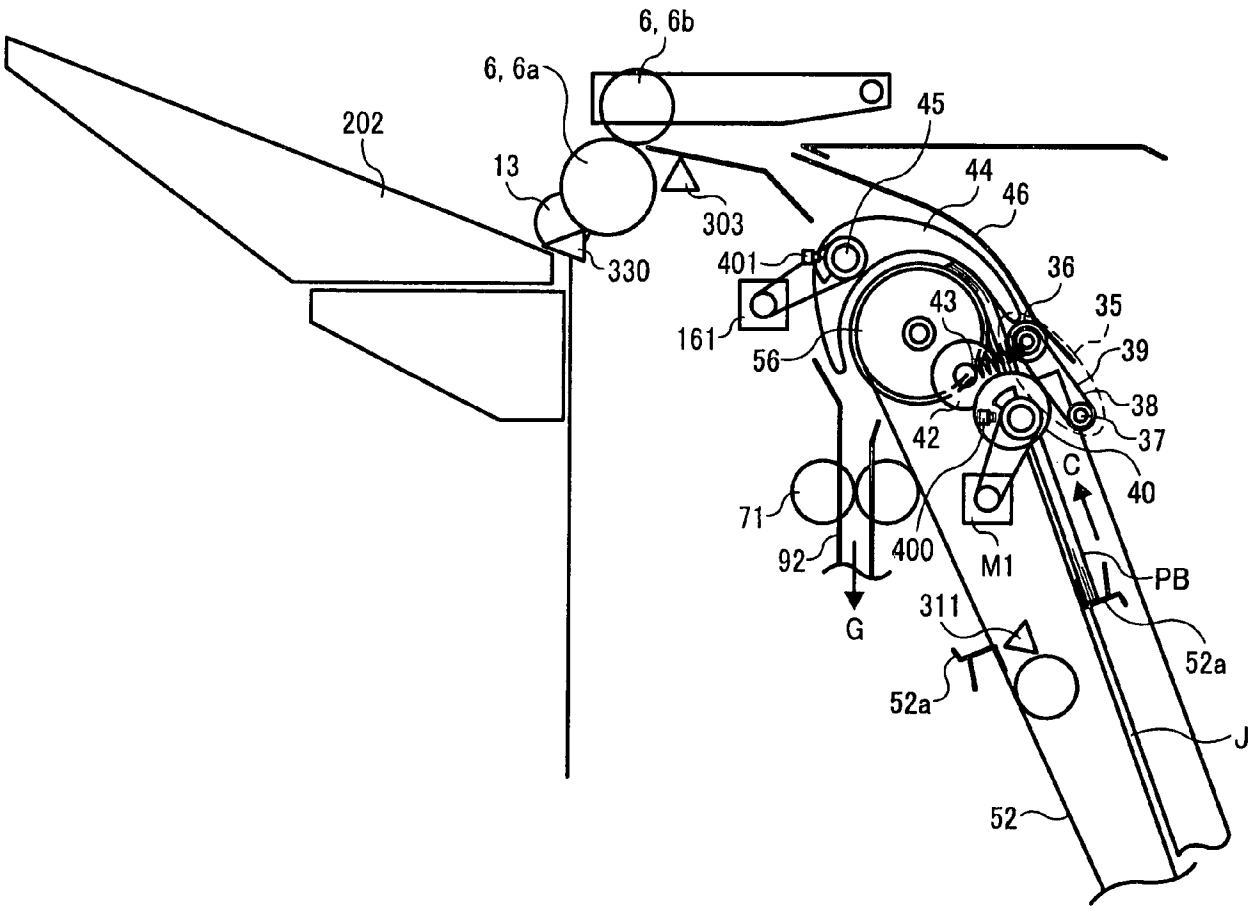
FIGS. 18A and 18B are views of the changing mechanism in the sheet bundle conveying direction depicted in FIGS. 17A and 17B, where
Figure 18B:
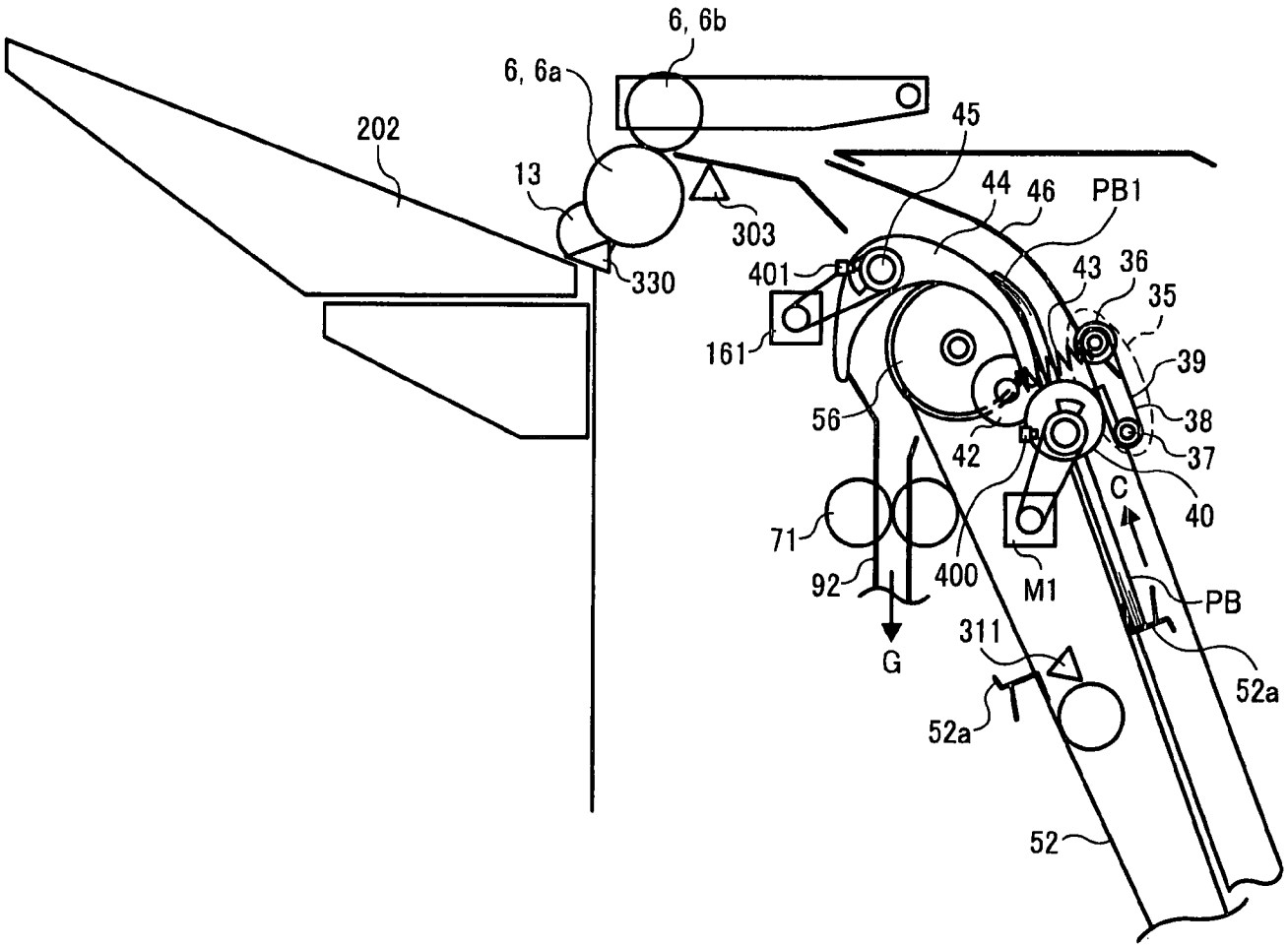

Subsequently, as shown in FIG. 18A, after the sheet bundle front end PB1 passes, the runner 36 of the conveying unit 35 is brought into contact with the surface of the sheet bundle PB to provide the conveying force. At this time, the guide member 44 and the discharge rollers 56 form a guide for the turned part, and convey the sheet bundle to the saddle stitch processing tray G on the downstream side. When supplying the sheet bundle from the end stitch processing tray F to the shift tray 202, as shown in FIG. 18B, the guide member 44 is swiveled, and the guide member 44 and a guide plate 46 form a conveying path leading to the shift tray 202. The rear end PB2 of the sheet bundle PB aligned in the end binding processing tray F is pushed up by the discharge claws 52*a*, and carried to the shift tray 202. It is to be noted that, in the present invention, the discharge roller 56 may be a driving roller that is driven by a motor or a driven roller that follows up conveying of the sheet bundle without driving.

Various kinds of structures of the conveying unit 35 can be considered. For example, as shown in FIG. 17A, a home position of the cam 40 that rotates and moves the conveying unit 35 may be detected by a sensor 400, and a rotation angle from the home position may be controlled by an additionally provided sensor and adjusted by pulse control of the motor M1. As shown in FIG. 17A, the driven roller 42 is arranged at a position facing the runner 36 of the conveying unit 35, and the driven roller 42 and the runner 36 sandwich the sheet bundle, and an elastic material 43 applies a pressure to provide a conveying force. Because a higher conveying force, i.e., a higher welding force is required when a paper thickness of the sheet bundle PB is increased, the runner 36 of the conveying unit 35 may be pressed against the driven roller 42 via the elastic material 43 and the cam 40, and the welding force may be adjusted based on an pressing angle of the cam 40 as shown in FIG. 17A.

Figure 21A:
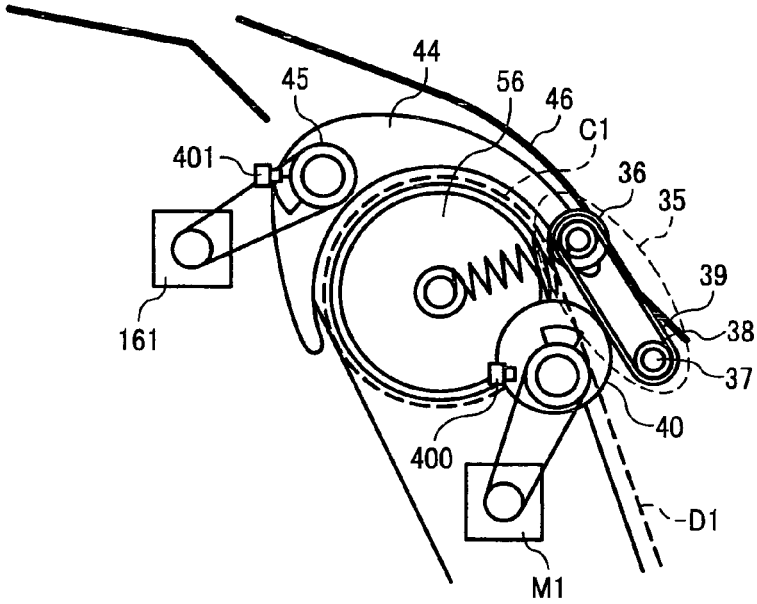
FIGS. 21A and 21B are views of a nipped state of a sheet bundle in the changing mechanism in the sheet bundle conveying direction depicted in FIG. 19, where
Figure 21B:
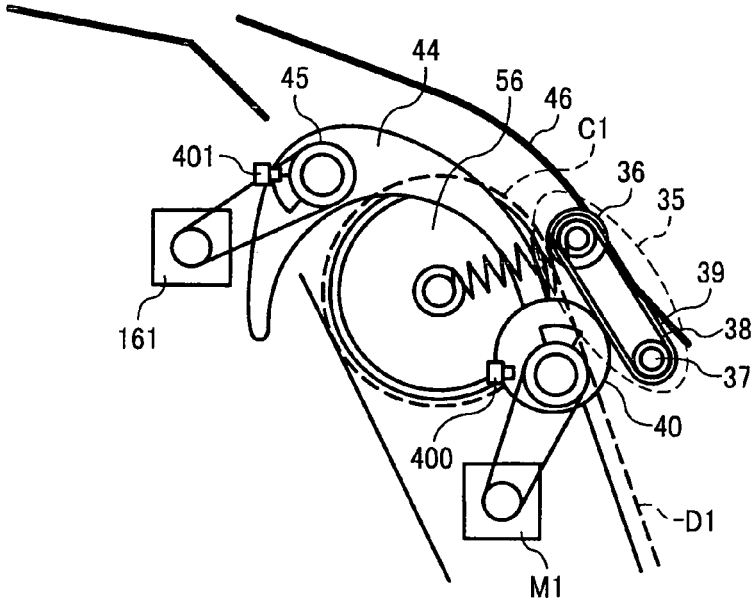

As shown in FIGS. 21A and 21B, the discharge roller 56 may be used in place of the driven roller 42 as the roller facing the runner 36 of the conveying unit 35, and a nipping position of the roller 36 and the discharge roller 56 in this example is near a contact position where a conveying trajectory line D1 of the sheet bundle PB is in contact with a concentric circle C1 of the discharge roller 56. The conveying path through which the sheet bundle PB is carried from the end binding processing tray F to the saddle stitch processing tray G is formed of the discharge roller 56 and the guide member 44 on the side facing the discharge roller 56, the guide member 44 swivels around a supporting point 45, and a driving force for this member is transmitted from a bundle branch driving motor 161. A home position of the guide member 44 is detected by a sensor 401. In regard to the conveying path through which the sheet bundle is carried from the end binding processing tray F to the shift tray 202 as a stacking unit, the guide member 44 and the guide plate 46 form the conveying path in a state where the guide member 44 swivels around the supporting point 45 as shown in FIG. 21B.

Figure 22:
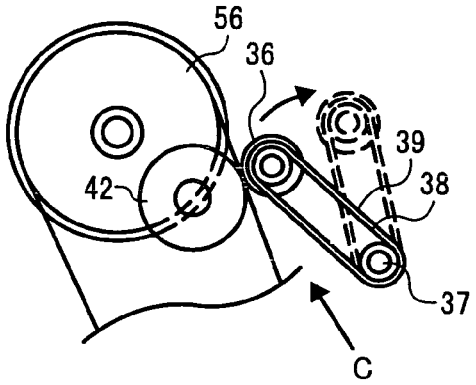
FIG. 22 is a view of another example in the changing mechanism in the sheet bundle conveying direction depicted in FIGS. 17A and 17B.
Figure 23:
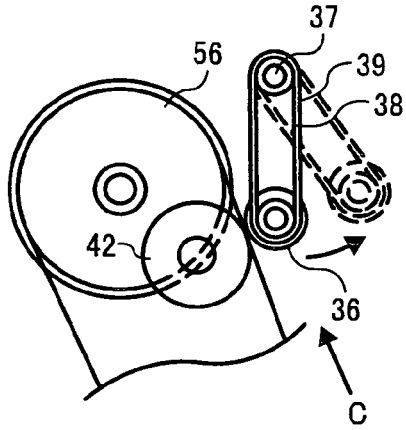
FIG. 23 is a view of still another example in the changing mechanism in the sheet bundle conveying direction depicted in FIGS. 17A and 17B.

The sheet bundle PB may be held and carried by the runner 36 of the conveying unit 35 and the driven roller 42 by swiveling (FIG. 22) the runner 36 from the same direction as the conveying direction C of the sheet bundle or by swiveling (FIG. 23) it from a direction opposite to the conveying direction as shown in FIGS. 22 and 23.

Figure 24:
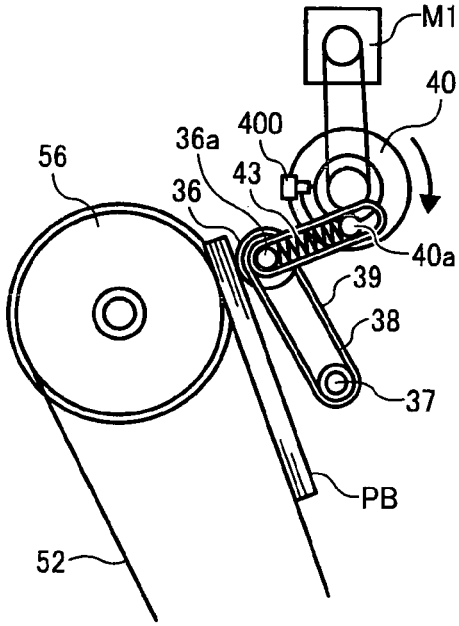
FIG. 24 is a view of yet another example in the changing mechanism in the sheet bundle conveying direction depicted in FIG. 19.

As shown in FIG. 24, a pin 40*a* of the cam 40 that adjusts the welding force of the runner 36 for the sheet bundle PB may be coupled with a supporting shaft 36*a* of the runner 36 through the elastic material (spring) 43 to adjust the welding force of the runner 36.

(3) Centerfold and Saddle Stitch Processing for Sheet

The centerfold and saddle stitch processing for sheet by a sheet post-processing unit device according to the embodiment will be explained.

<Centerfold Processing>

The sheet bundle PB carried to the processing tray G in a state where the front end PB1 and the rear end PB2 of the sheet bundle are aligned in the processing tray F is folded at a central part of the sheet bundle PB in the longitudinal direction by a folding plate 74 arranged in the processing tray G, and a movement mechanism for the folding plate 74 will now be explained with reference to FIGS. 25A and 25B.

Figure 25A:
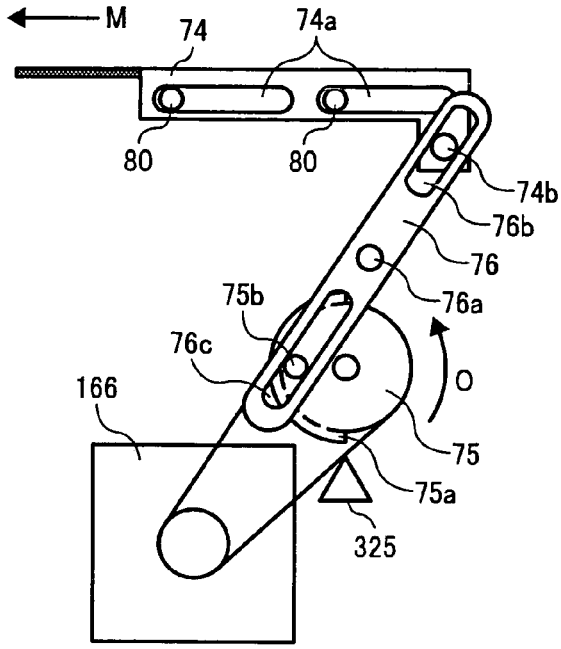
FIGS. 25A and 25B are views of a lateral movement mechanism of a folding plate used in the sheet post-processing unit device in the image forming apparatus according to the embodiment of the present invention, where
Figure 25B:
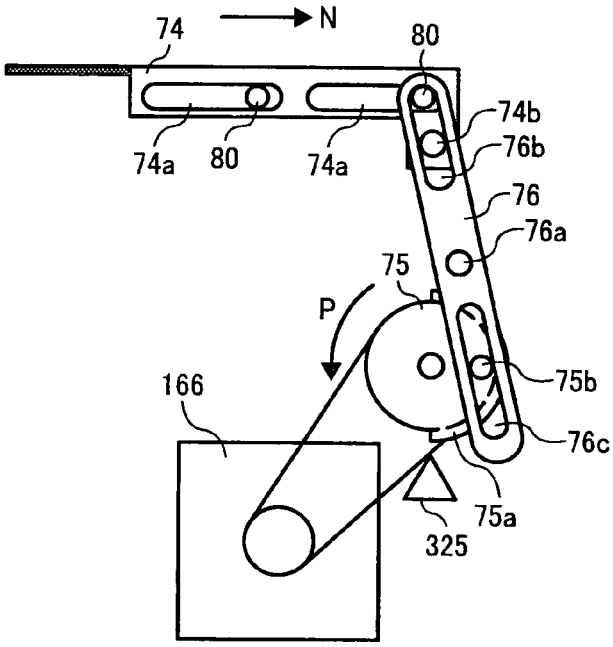

As shown in FIG. 25A, the folding plate 74 is supported when respective two pins 80 placed on front and rear side plates are fitted in slots 74*a*, a shaft 74*b* of the bending plate 74 is fitted in a slot 76*b* of a link arm 76, and the bending plate 74 reciprocates in the lateral direction when the link arm 76 oscillates around a supporting point 76*a*. A shaft 75*b* of a bending plate driving cam 75 is fitted in a slot 76*c* of the link arm 76, and the link arm 76 oscillates based on a rotating motion of the bending plate driving cam 75. The bending plate driving cam 75 rotates in a direction indicated by an arrow O in FIG. 25A by a bending plate driving motor 166. A stop position of the bending plate driving cam 75 is determined when both ends of a semicircular shield unit 75*a* are detected by a plate HP sensor 325.

FIG. 25A depicts a home position of the bending plate 74 completely retracted from a sheet bundle accommodating region in the processing tray G. When the bending plate driving cam 75 is rotated in the direction indicated by the arrow O, the bending plate 74 is moved in a direction indicated by an arrow M and protrudes in the sheet bundle accommodating region in the processing tray G. FIG. 25B depicts a position where the sheet bundle PB in the processing tray G is bent at the center and the bending plate 74 is pushed into a nip of the bending roller 81. When the bending plate driving cam 75 is rotated in a direction indicated by an arrow P, the bending plate 74 moves in a direction indicated by an arrow N to be retracted from the sheet bundle accommodating region in the processing tray G.

<Saddle Stitch Processing>

Figure 26A:
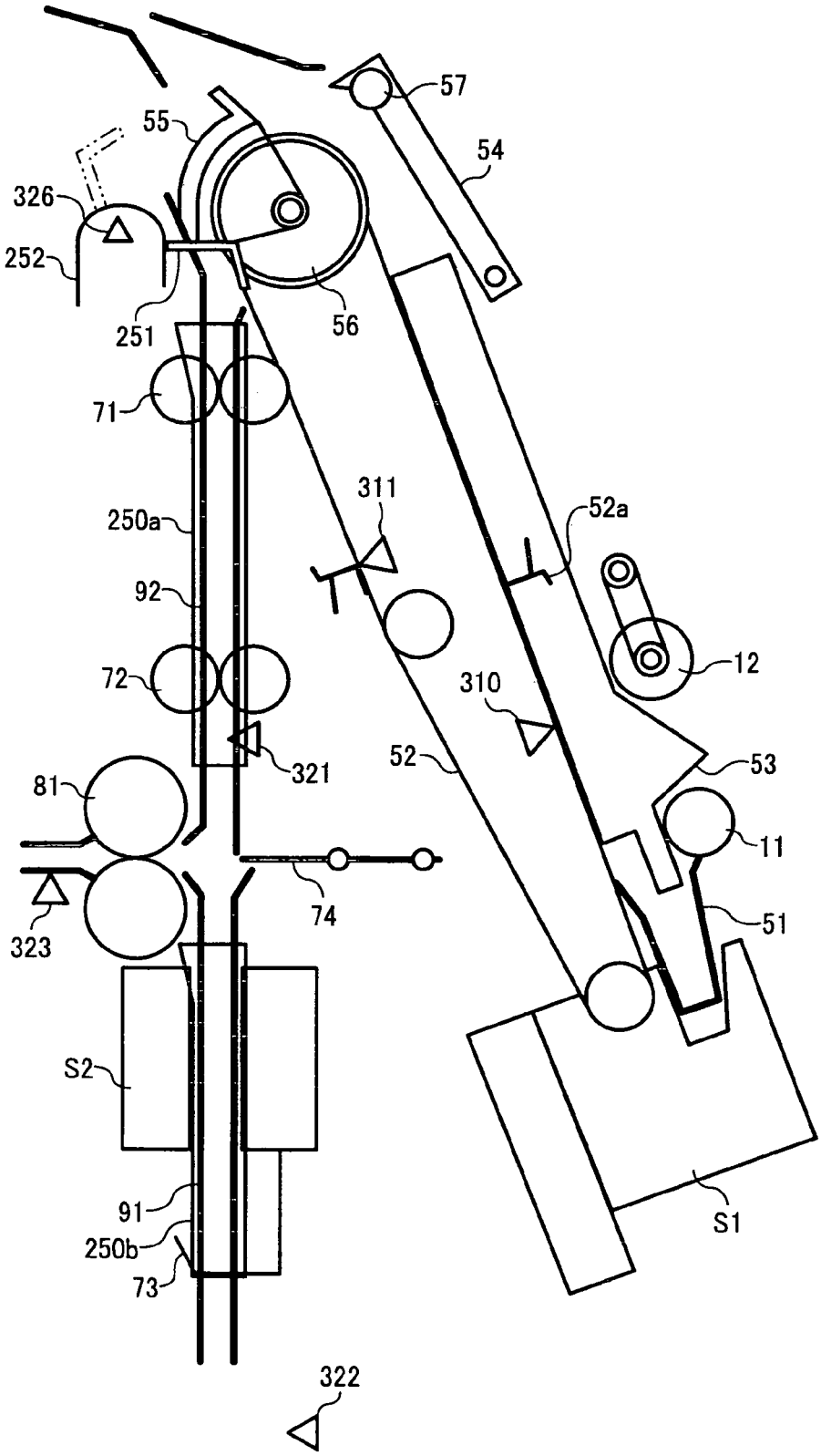
FIGS. 26A to 26E are views of a changing mechanism in a sheet bundle conveying direction according to another example used in the sheet post-processing unit device in the image forming apparatus according to the embodiment of the present invention, where
Figure 26B:
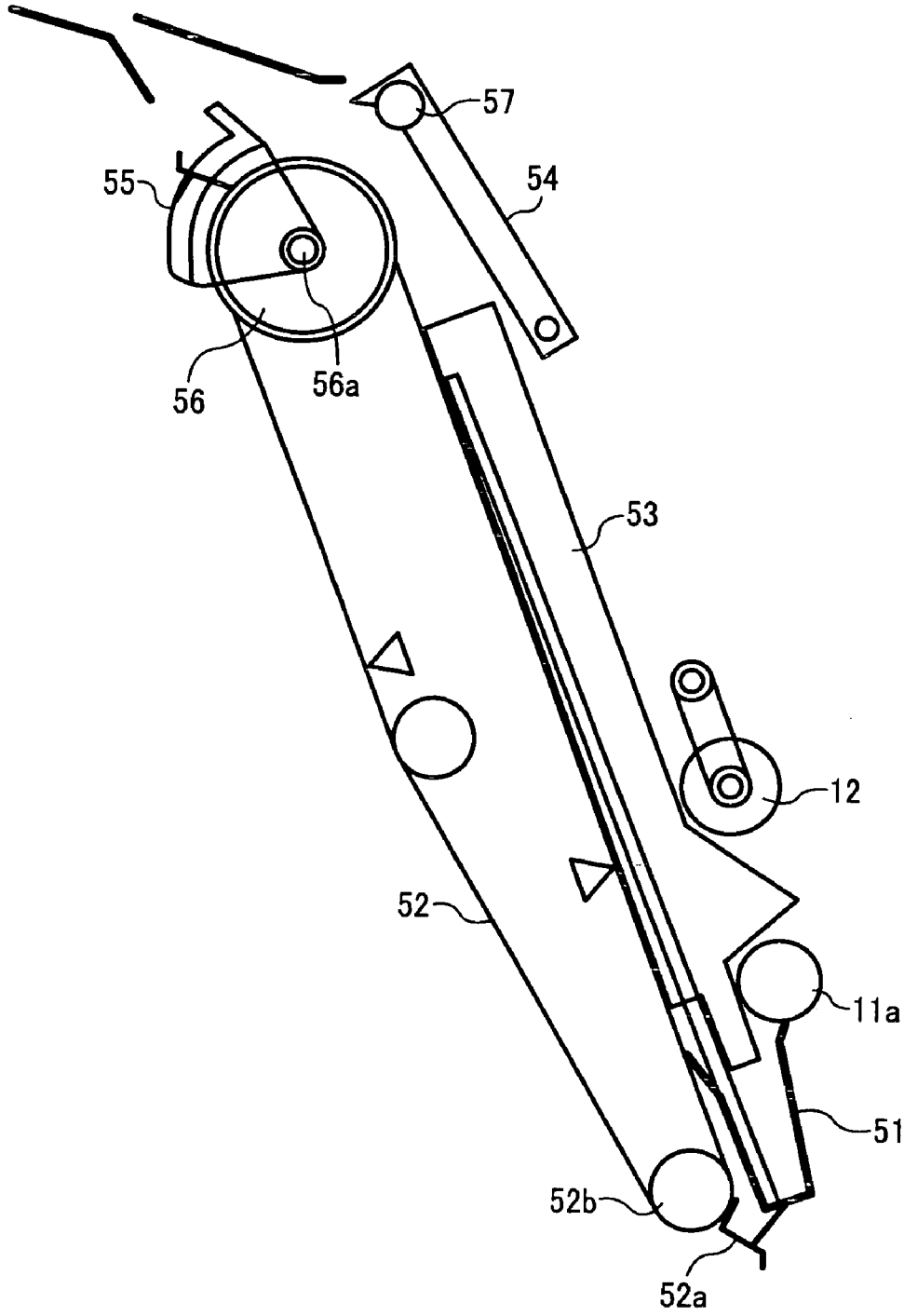
Figure 26C:
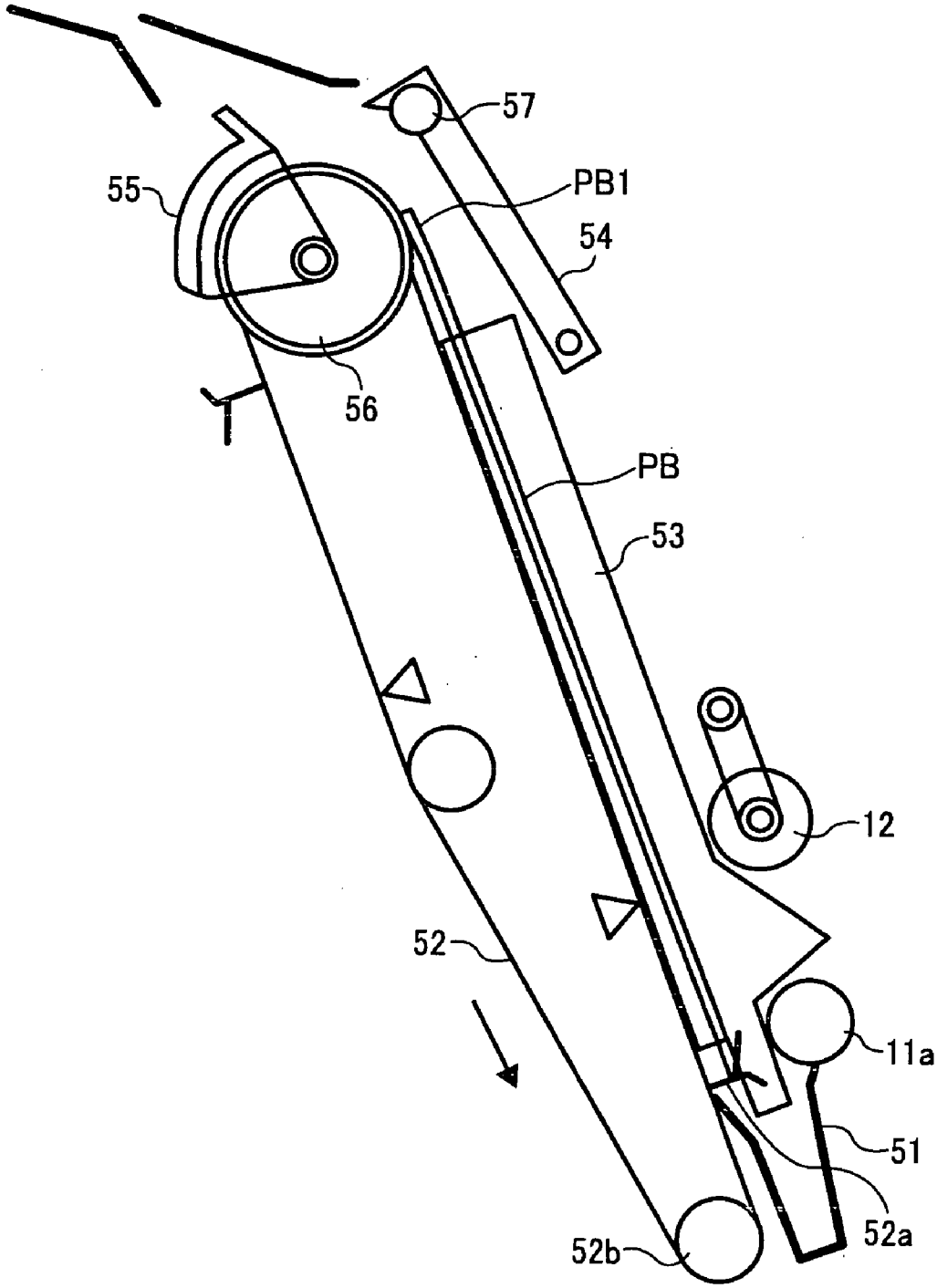

An operation in a saddle stitch book binding mode will now be explained with reference to FIGS. 26A to 26E and 27A to 27D. It is to be noted that an example where a structure different from the conveying direction changing unit depicted in FIGS. 17A and 17B is adopted as a conveying direction changing unit for the sheet bundle PB depicted in FIGS. 26A to 26E will be explained, but a method of changing the conveying direction of the sheet bundle PB from the processing tray F to the processing tray G is basically the same. That is, in this example, as shown in FIGS. 26B to 26D, the sheet bundle PB moved up in the conveying path J by the discharge claw 52*a* of the discharge belt 52 is carried by the branch guide plate 54 having a pressure runner 57 disposed at a distal end thereof to allow its swiveling motion and the discharge roller 56 that rotates for driving, and it is turned along a movable guide 55 to be carried to the processing tray G by swiveling the movable guide 55 disposed to a shaft center 56*a* of the discharge roller 56 to allow its swiveling motion.

Figure 26D:
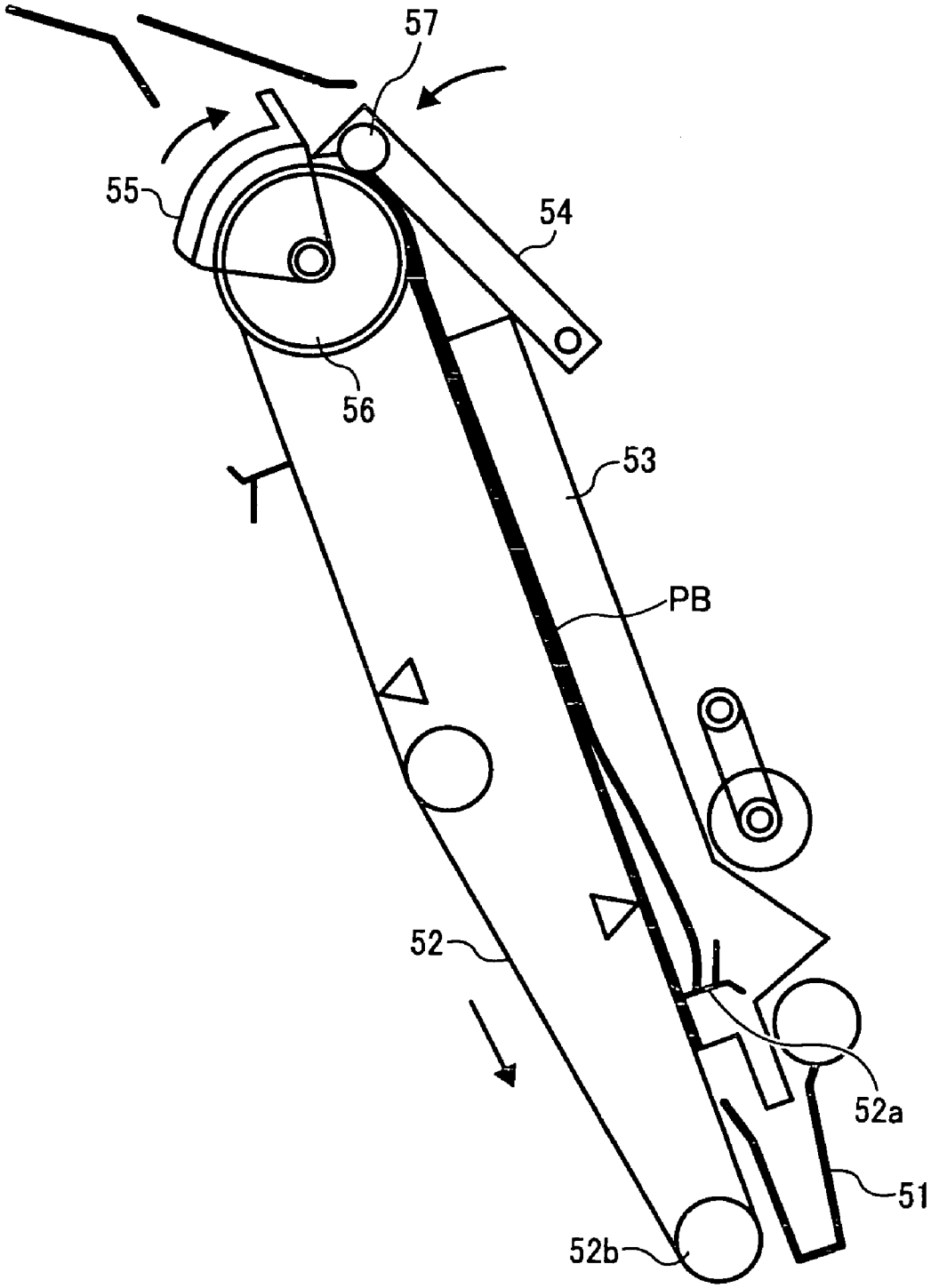
Figure 26E:
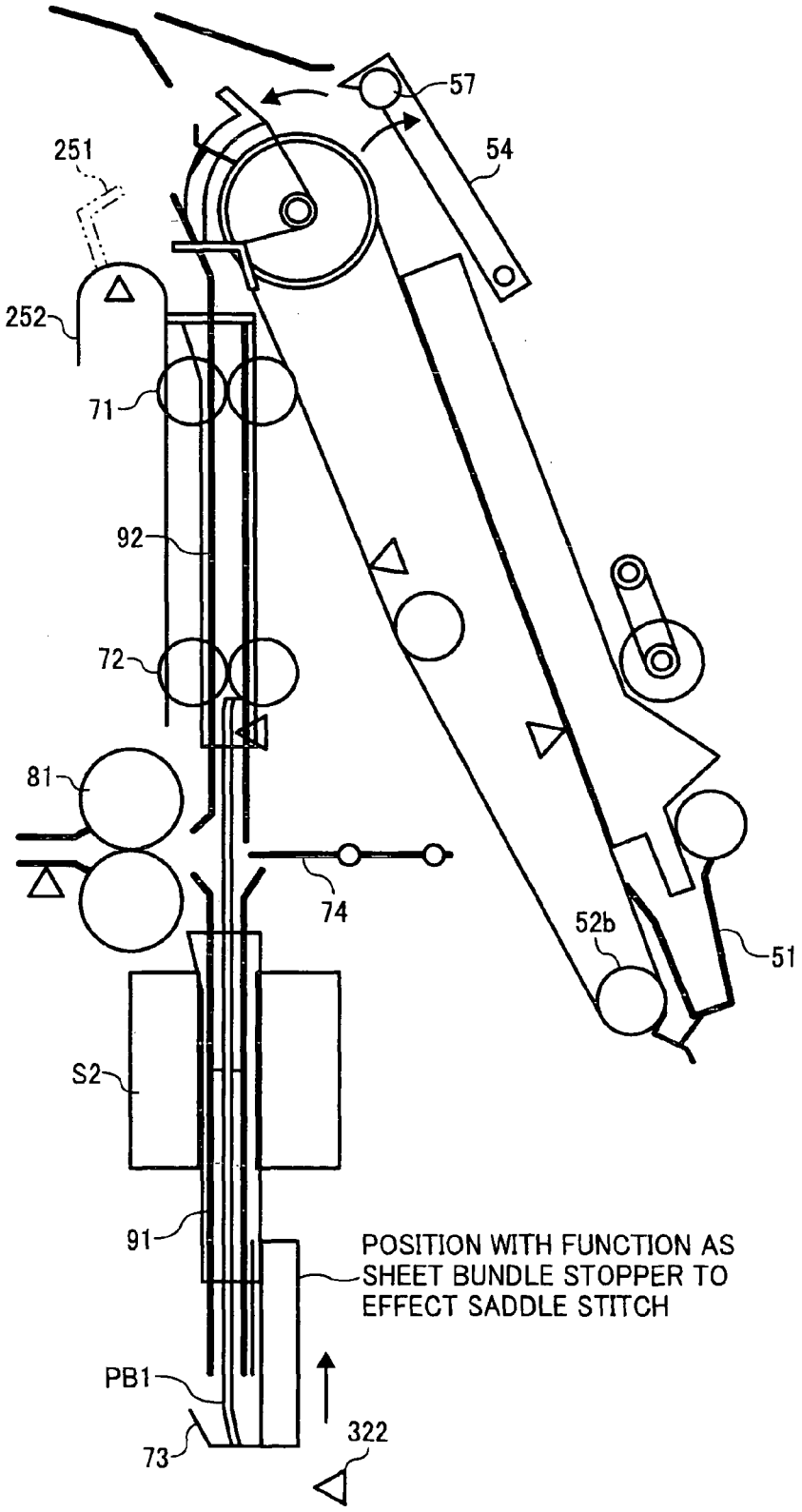

After the sheet bundle PB is temporarily aligned in the processing tray F, as shown in FIG. 26D, the sheet bundle front end PB1 is held between the discharge roller 56 and the pressure runner 57, and again carried toward the downstream side by the discharge claw 52*a* and the discharge roller 56 so as to pass through the path leading to the processing tray G when the branch guide plate 54 and the movable guide 55 swivel. This discharge roller 56 is provided to a driving shaft of the discharge belt 52, and driven in synchronization with the discharge belt 52.

Figure 27A:
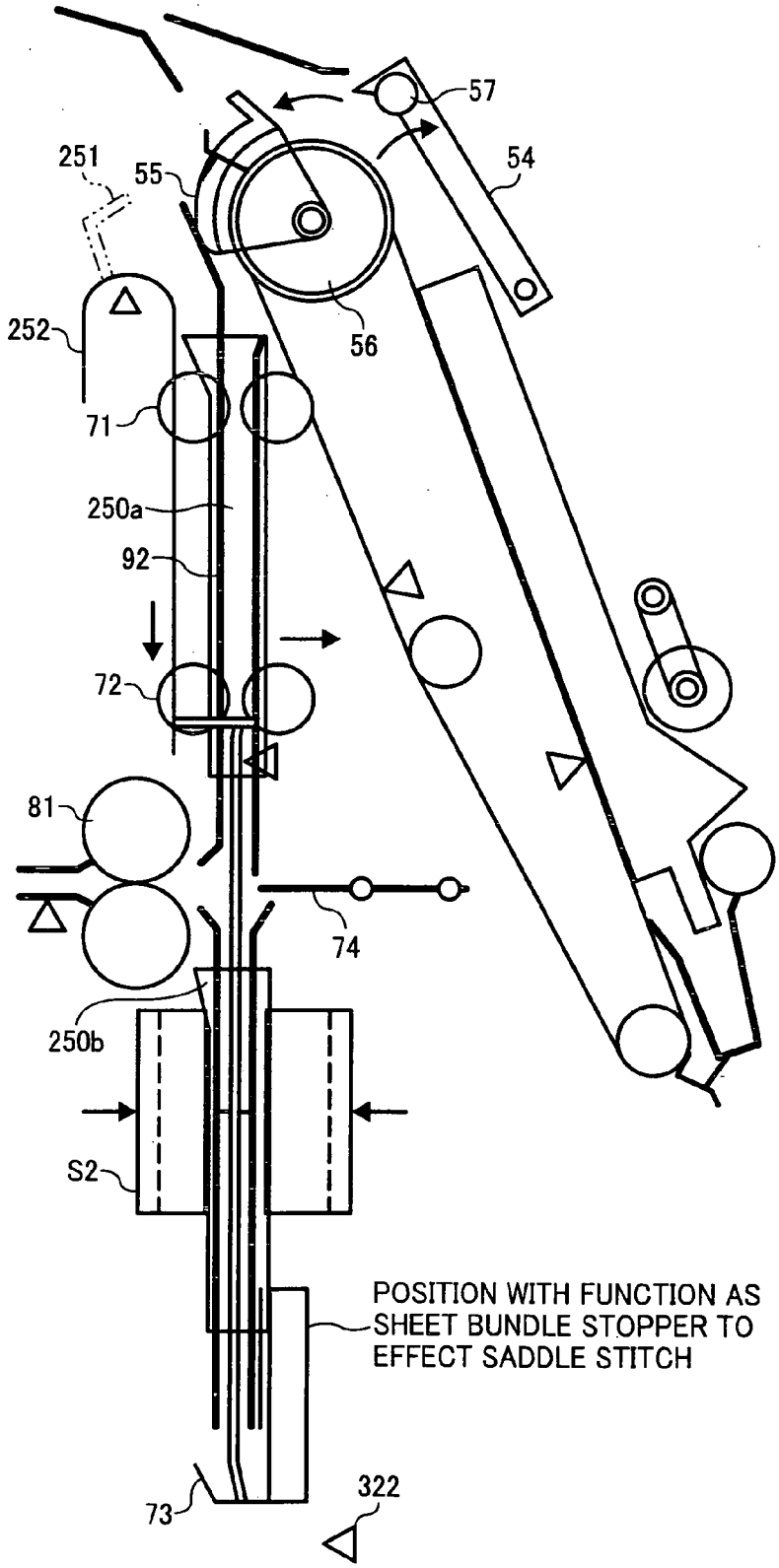
FIGS. 27A to 27D are views of saddle stitch processing and centerfold processing for the sheet bundle carried out by using the changing mechanism in the sheet bundle conveying direction depicted in FIGS. 26A to 26E, where

Thereafter, the sheet bundle PB is carried by the discharge claw 52*a* until the sheet bundle rear end PB2 passes the discharge roller 56, and it is further carried to a position where the front end PB1 of the sheet bundle PB comes into contact with a movable rear end fence 73 by bundle conveying upper rollers 71 and bundle conveying lower rollers 72. At this time, a stop position of the movable rear end fence 73 varies depending on a size of each sheet bundle PB in the conveying direction, and the movable rear end fence 73 waits there. When the sheet bundle front end PB1 is brought into contact with and stacked in the waiting movable rear end fence 73, displacement may possibly occur in the sheet bundle PB until the sheet bundle PB temporarily aligned in the processing tray F is stacked in the movable rear end fence 73 as shown in FIG. 27A, a pressure of the bundle conveying lower rollers 72 is released because final alignment must be carried out by a rear end tapping claw 251, and the rear end tapping claw 251 taps the rear end PB2 of the sheet bundle PB, thereby effecting final alignment in the conveying direction.

Immediately after this operation, final alignment in the width direction is carried out by a saddle stitch upper jogger fence 250*a* and a saddle stitch lower jogger fence 250*b*, and the center of the sheet bundle is bound by a saddle stitch stapler S2. Here, the movable rear end fence 73 is positioned based on pulse control from a movable rear end fence HP sensor 322, and the rear end tapping claw 251 is positioned based on pulse control from a rear end tapping claw HP sensor 326.

Figure 27B:
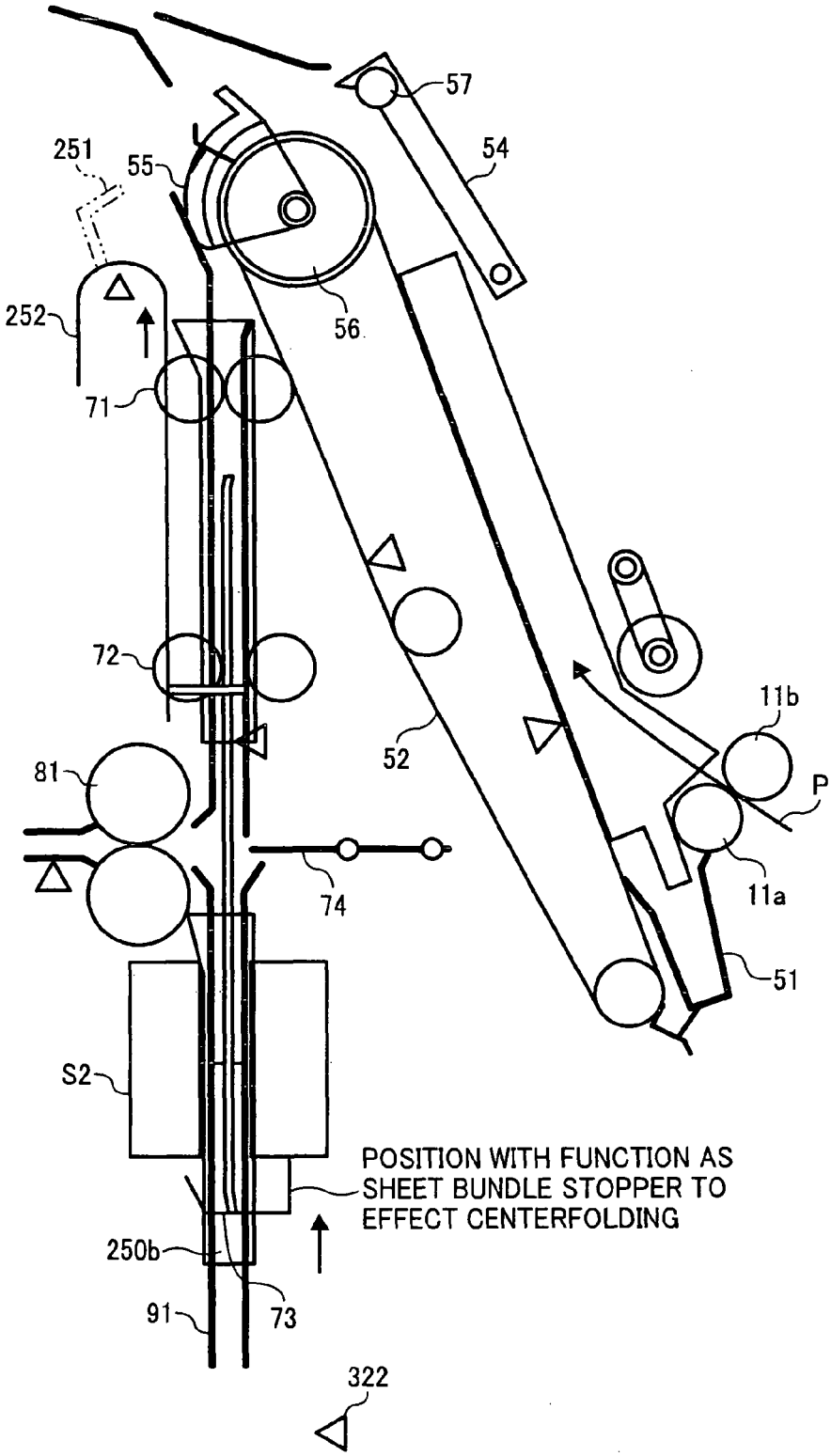
Figure 27C:
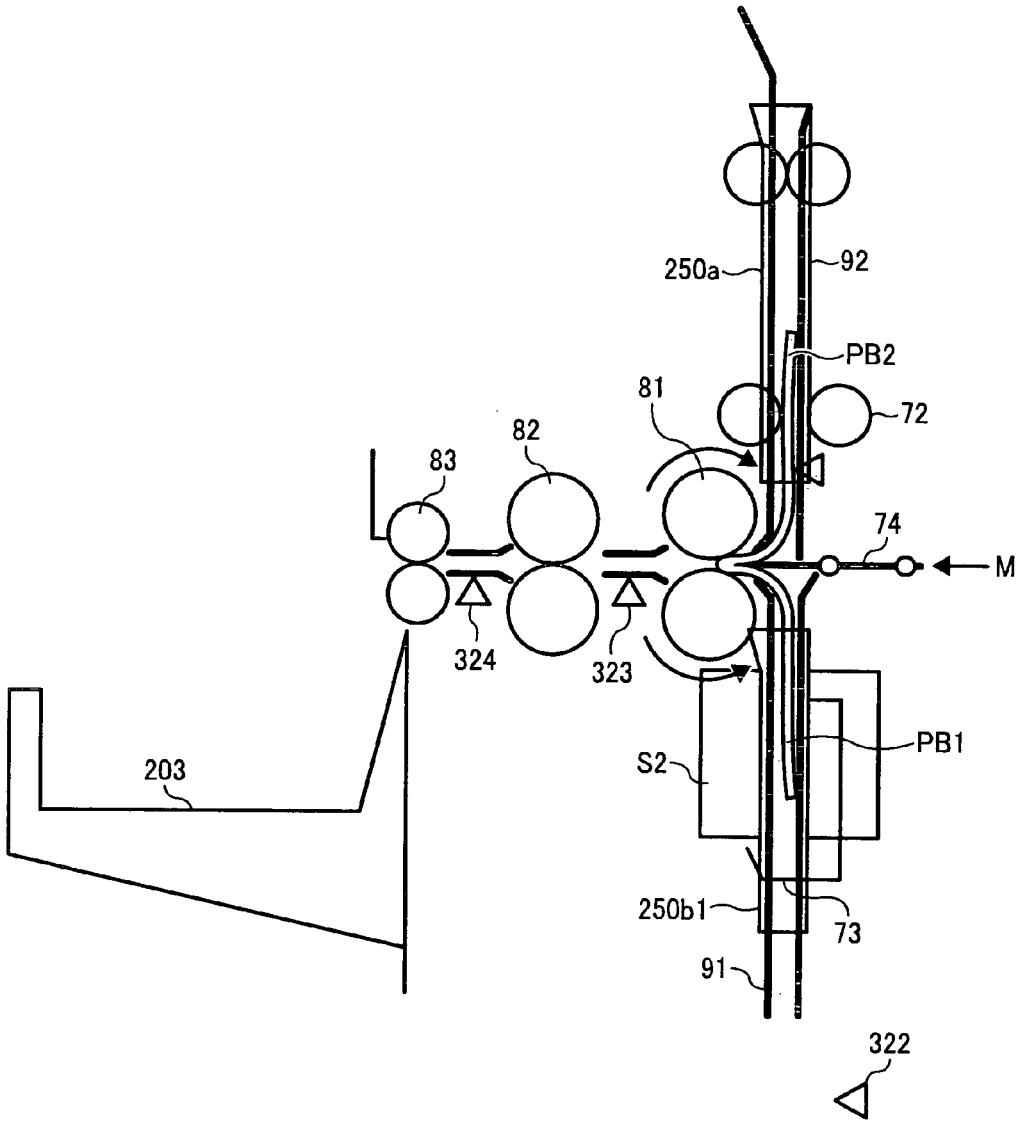

As shown in FIG. 27B, the sheet bundle subjected to saddle stitch is moved up with movement of the movable rear end fence 73 with the pressure of the bundle conveying lower rollers 72 being released, and then a bound part near a needle portion is pushed in a substantially perpendicular direction by the bending plate 74 and led to a nip of the opposed bending rollers 81 as shown in FIG. 27C. The bending rollers 81 that rotate in advance convey the sheet bundle PB with a pressure, thereby bending the sheet bundle PB at the center. Here, the saddle-stitched sheet bundle PB moves up for bending processing, and hence the sheet bundle PB can be assuredly carried based on movement of the movable rear end fence 73 alone. If the sheet bundle PB is to be moved down for bending processing, movement of the movable rear end fence 73 alone lacks assuredness, and another unit, e.g., conveying rollers is required, leading to a complicated structure. However, in this embodiment, because the bending plate 74 bends the sheet bundle PB at the center and, at the same time, the central part of the bent sheet bundle PB is carried to the bending rollers 81, the sheet bundle PB does not have to be moved down, and conveying the sheet bundle PB upwards enables appropriately conveying the central part of the sheet bundle PB to a position of the bending plate 74.

Figure 27D:
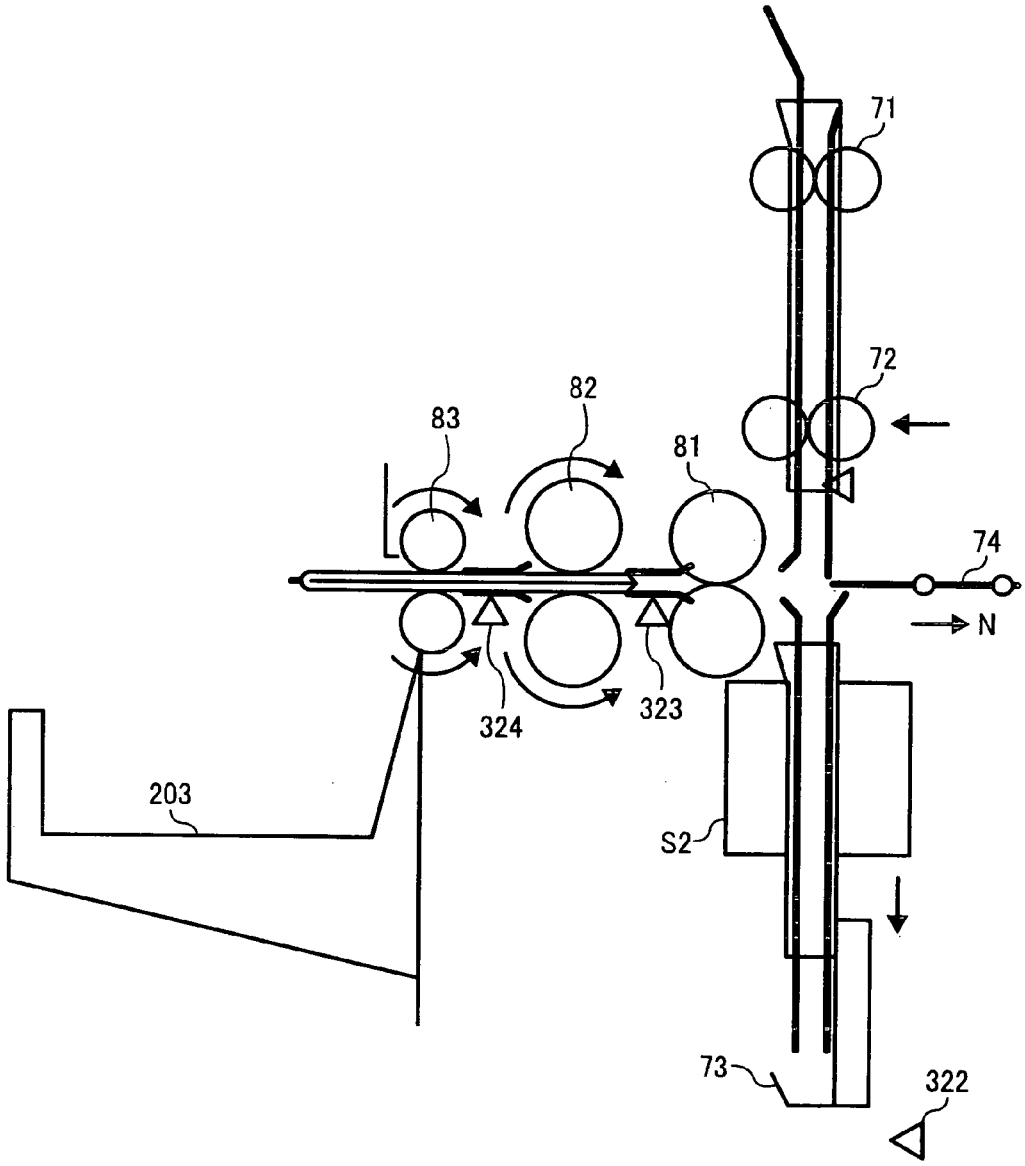

As shown in FIG. 27D, a bending propensity of the bent sheet bundle PB is intensified by second bending rollers 82, and the sheet bundle PB is discharged to the lower tray 203 by lower paper discharge rollers 83. At this time, when the sheet bundle rear end PB2 is detected by a bent part passage sensor 323, the bending plate 74 and the movable rear end fence 73 return to their home positions, the pressure of the bundle conveying lower rollers 72 is restored to brace for supply of the next sheet bundle PB. If the next job has the same sheet size and the same number of sheets, the movable rear end fence 73 may again move to a position depicted in FIG. 26E and wait.

As explained above, the sheet post-processing unit device according to this embodiment can take the following discharge modes (A) to (E) based on the respective post-processing modes.

(A) Non-staple mode a: the sheet is discharged to the upper tray 201 through the conveying path A and the conveying path B.

(B) Non-staple mode b: the sheet is discharged to the shift tray 202 through the conveying path A and the conveying path C.

(C) Sort or stack mode: the sheet is discharged to the shift tray 202 through the conveying path A and the conveying path C. At this time, when the shift tray 202 oscillates in a direction perpendicular to the paper discharging direction in each interval between copies, the sheet to be discharged is sorted.

(D) Staple mode: the sheet is aligned and bound in the processing tray F through the conveying path A and the conveying path D, and it is discharged to the shift tray 202 via the conveying path C.

(E) Saddle stitch book binding mode: the sheet is aligned in the processing tray F through the conveying path A and the conveying path D, then saddle-stitched and centerfolded in the processing tray G, and discharged to the lower tray 203 via the conveying path H.

(A) An operation in the non-staple mode a will now be explained. The sheet P distributed by the branch claw 15 from the conveying path A is led to the conveying path B and discharged to the upper tray 201 by the conveying rollers 3 and the upper paper discharge rollers 4. An upper paper discharge sensor 302 that is arranged near the upper paper discharge rollers 4 and detects discharge of the sheet P monitors a state of paper discharge.

(B) An operation in the non-staple mode b will now be explained. The sheet P distributed from the conveying path A by the branch claw 15 and the branch claw 16 is led to the conveying path C and discharged to the shift tray 202 by the conveying rollers 5 and the shift paper discharge rollers 6. The shift paper discharge sensor 303 that is arranged near the shift paper discharge rollers 6 and detects discharge of the sheet P monitors a state of paper discharge.

(C) An operation is the sort or stack mode will now be explained. The same paper conveying and paper discharge as those in (B) the non-staple mode b are performed. At this time, the shift tray 202 oscillates in a direction perpendicular to the paper discharging direction in each interval between copies, thereby sorting the sheets.

(D) An operation in the staple mode will now be explained. The sheet distributed from the conveying path A by the branch claw 15 and the branch claw 16 is led to the conveying path D and discharged to the processing tray F by the conveying rollers 7, the conveying rollers 9, the conveying rollers 10, and the staple paper discharge rollers 11. In the processing tray F, the staple paper discharge rollers 11 align the sequentially discharged sheet P, and the facet binding stapler S1 performs binding processing when the sheets reach a predetermined number.

Then, the bound sheet bundle PB is carried to the downstream side by the discharge claw 52*a* and discharged to the shift tray 202 by the shift paper discharge rollers 6. The shift paper discharge sensor 303 that is arranged near the shift paper discharge rollers 6 and detects discharge of the sheet monitors a state of paper discharge.

Figure 28:
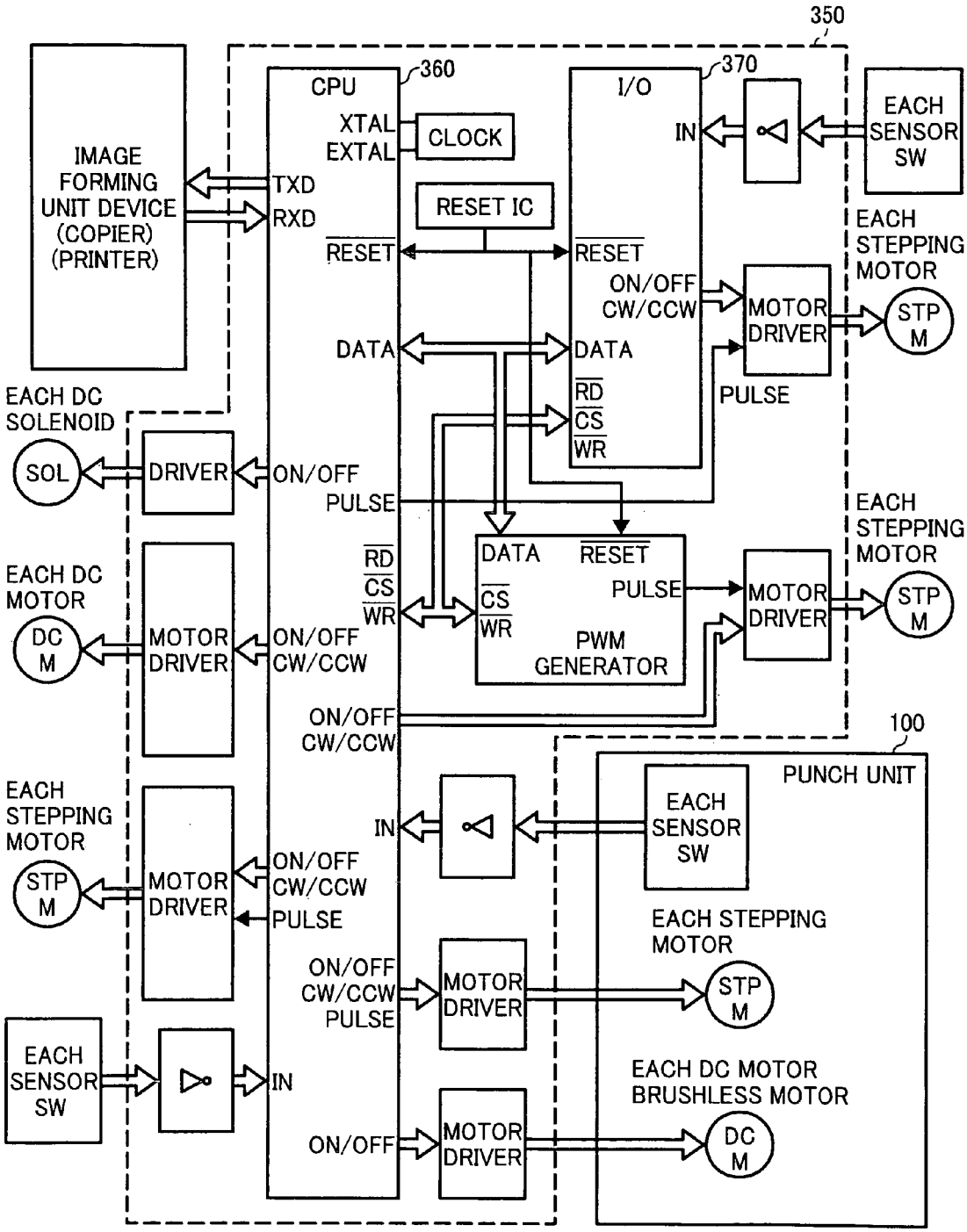
FIG. 28 is a block diagram of a controlling unit that operates the sheet post-processing unit device in the image forming apparatus according to the embodiment of the present invention.

The above operations are effected by a computer included in the sheet post-processing unit device, and FIG. 28 is a block diagram thereof. As shown in FIG. 28, the controlling unit 350 is a microcomputer having, e.g., a CPU 360, an I/O interface 370, and others, and signals from respective sensors, e.g., each switch on a control panel in the non-depicted image forming apparatus main body, a paper surface detection sensor 330, and others are input to the CPU 360 via the I/O interface 370. Based on input signals, the CPU 360 controls driving, e.g., the tray elevating motor 168 for the shift tray 202, the paper discharge guide plate opening/closing motor 167 that opens/closes the opening/closing guide plate, the shift motor 169 that moves the shift tray 202, a tapping runner motor 156 that drives the tapping runner 12, each solenoid of, e.g., the tapping SOL 170, the conveying motor that drives each conveying roller, the paper discharge motor that drives each paper discharge roller, the discharge motor 157 that drives the discharge belt 52, the stapler moving motor 159 that moves the facet binding stapler S1, the oblique motor 160 that obliquely rotates facet binding stapler S1, the jogger motor 158 that moves each jogger fence 53, the bundle branch driving motor 161 that swivels the guide member 44, the bundle conveying motor 162 that drives the conveying roller that conveys the bundle, a rear end fence moving motor 163 that moves the movable rear end fence 73, the bending plate driving motor 166 that moves the bending plate 74, a bending roller driving motor 164 that drives the bending roller 81, and others. A pulse signal from a non-depicted staple conveying motor 155 that drives the staple paper discharge rollers is input to the CPU 360 to be counted, and the tapper SOL 170 and the jogger motor 158 are controlled according to this counting.

As described above, according to one aspect of the present invention, adopting the above structure enables providing the sheet processing apparatus that reduce a waiting time until a sheet is put into a tray, e.g., a staple tray where the sheets are stocked as much as possible to improve productivity of sheet bundles, and an image forming apparatus including the sheet processing apparatus.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing apparatus that includes a conveying unit that conveys a sheet and a tray where a carried sheet is stacked, the sheet processing apparatus comprising:

an aligning unit that aligns a front end of a sheet bundle stacked in the tray in a discharging direction; and a sheet bundle conveying unit that holds a rear end of the sheet bundle and conveys the sheet bundle in the discharging direction, wherein:

the aligning unit is arranged to be retracted from a conveying path of the sheet bundle after aligning the front end of the sheet bundle and arranged to come out of the conveying path of the sheet bundle behind the sheet bundle conveying unit after a movement of the sheet bundle conveying unit, the aligning unit is mounted on a first endless conveying belt stretched in the conveying path of the sheet bundle, the sheet bundle conveying unit is mounted on a second endless conveying belt stretched in the conveying path of the sheet bundle, the aligning unit is mounted in a freely swiveling manner in the conveying direction of the sheet bundle, and includes a pressing unit that presses the front end of the sheet bundle in a direction opposite to the conveying direction of the sheet bundle, the aligning unit includes a support for supporting the front end of the sheet bundle, the support further includes a front end tapper and disposed to freely swivel around a supporting point, and the pressing unit is disposed between the support and the front end tapper.

2. The sheet processing apparatus according to claim 1, wherein the aligning unit is retracted from a return path of the sheet bundle and comes out again by a swiveling motion of the conveying belt.

3. The sheet processing apparatus according to claim 1, wherein a transferring speed of the aligning unit is equal to or lower than a moving speed of the sheet bundle conveying unit.

4. The sheet processing apparatus according to claim 1, wherein the sheet bundle conveying unit includes a holding unit that is mounted on the second conveying belt and holds the rear end of the sheet bundle.

5. The sheet processing apparatus according to claim 1, wherein the tray includes a rear end fence, and the aligning unit aligns the front end of the sheet bundle by bringing the rear end of the sheet bundle into contact with the rear end fence of the tray.

6. The sheet processing apparatus according to claim 5, wherein a plurality of rear end fences are arranged at intervals in a direction perpendicular to the conveying direction of the sheet bundle.

7. The sheet processing apparatus according to claim 1, wherein the pressing unit is an elastic member.

8. The sheet processing apparatus according to claim 1, wherein the tray includes a stapling unit that staples the sheet bundle.

9. The sheet processing apparatus according to claim 1, wherein the aligning unit is retracted to a home position on a rear surface side of the tray.

10. The sheet processing apparatus according to claim 1, wherein the front end tapper swivels upward against an elastic force of the pressing unit to press the sheet toward a substrate side of the tray so as to align the front end of the sheet.

* * * * *